US006327991B1

(12) United States Patent
Eichert

(10) Patent No.: US 6,327,991 B1
(45) Date of Patent: Dec. 11, 2001

(54) BOAT MAINTENANCE

(76) Inventor: John E. Eichert, 7570 Union Rd., Paso Robles, CA (US) 93446

( * ) Notice: Subject to any disclaimer, the term of this patent is extended or adjusted under 35 U.S.C. 154(b) by 0 days.

(21) Appl. No.: 09/545,282

(22) Filed: Apr. 7, 2000

(51) Int. Cl.[7] ..... B63B 59/08
(52) U.S. Cl. ..... 114/222
(58) Field of Search ..... 114/222

(56) References Cited

U.S. PATENT DOCUMENTS

| | | |
|---|---|---|
| 3,142,283 | 7/1964 | Fisher . |
| 3,570,256 | 3/1971 | Thompson . |
| 3,685,477 | 8/1972 | Wood . |
| 3,752,109 | 8/1973 | Seiple . |
| 4,215,644 | 8/1980 | Jackson . |
| 4,280,436 | 7/1981 | Jackson . |
| 4,282,822 | 8/1981 | Jackson . |
| 4,506,686 | 3/1985 | Bailard et al. . |
| 4,510,877 | 4/1985 | Bloxham . |
| 4,784,078 | 11/1988 | Feurt . |
| 5,138,963 | 8/1992 | Eichert . |
| 5,152,242 | 10/1992 | Bradley . |
| 5,279,244 | 1/1994 | Perez-Collazo . |
| 5,549,069 | 8/1996 | Faidi . |

*Primary Examiner*—Sherman Basinger
(74) *Attorney, Agent, or Firm*—Leo F. Costello

(57) ABSTRACT

An apparatus and method for cleaning a boat in the water without pollution. Included are a floating, water-impervious basin and a filtration system. Included are a floating, water-impervious basin and a filtration system. The basin has side walls sloped downwardly to a nadir spanning substantially the full length of the basin, an opening allowing the surrounding water to enter the basin as well as ingress and egress of boats, and a gate movable into a closed position forming a cleaning chamber in the basin. After a boat is in the chamber, the gate is closed to create a pool of water in the chamber isolated from the surrounding water and in which a boat may float while being cleaned. As the gate is closing behind a boat, it allows water to pass therethrough thereby to facilitate closure, and yet is substantially sealed when closed. The filtration system includes a collector pipe lying submerged in the nadir and a pair of return pipes that float on the water in the basin. The sloped side walls and water exiting from the return pipes facilitate movement of materials resulting from the cleaning operation toward the collector pipe. The filtration system sucks the water-borne materials into the collector pipe, pumps them through a filter, and returns clean water to the basin through the return pipes. The relationship of the pipes and the basin facilitates reversibility of the basin so that its exterior surface may be periodically cleaned.

55 Claims, 15 Drawing Sheets

BOAT MAINTENANCE

FIELD

The present invention pertains to boat maintenance and more particularly to a method and apparatus for cleaning a boat in the water while avoiding or minimizing pollution.

BACKGROUND

The necessity of having to clean the hull of a boat periodically has long been known. Marine organisms must be removed for hull preservation and boat efficiency. Hulls may need old paint removed and new paint applied. Decks and other boat parts also need to be cleaned. If the boat is cleaned in the water, these cleaning tasks typically involve brushing both above and below the waterline. Sanding and the use of various cleaning agents and paint strippers may also be used above the waterline.

Although such cleaning may be effective to maintain a boat, boat cleaning is also known to result in air and/or water pollution, unless special precautions are taken. Brushing and sanding the hull release contaminants, such as old paint containing lead. If cleaners are used, they are usually toxic. Even if the deck of a boat is washed down with fresh water, polluting materials can be discharged or washed overboard.

Voluntary campaigns to control pollution from boat cleaning have been organized, but unfortunately these efforts have not been sufficiently effective. Because of continued concerns about the environment, ever more stringent federal and state laws and programs with tough penalties have been, or are being, enacted or proposed. Under these laws, severe fines and even jail terms have been imposed for those who still pollute the harbor waters as a result of boat cleaning.

A well-recognized way of avoiding water pollution is to clean the boat on land, although the problem of air pollution still exists. Moreover, having to haul a boat onto land to perform the cleaning tasks is inconvenient and expensive, especially burdensome for routine maintenance. As a result many boats are still being cleaned in the water notwithstanding the resulting pollution.

Apart from applicant, no practical and relatively economical solution to the environmental problems associated with routine boat cleaning is known to exist in the past. Some have tried to minimize the fouling of the boat's hull by covering it while moored. For example, the U.S. Patent to Faidi U.S. Pat. No. 5,549,069 discloses a bag that is pressed against the hull a shield the hull from the water. However, providing a protective cover for the hull does not directly address the problem of cleaning as described above, which in any event may be required. If chemicals are placed in the bag to dissolve marine growths, the chemicals may escape into the water. On the other hand, the U.S. Patents to Seiple U.S. Pat. No. 3,752,109 and to Feurt U.S. Pat. No. 4,784,078 do disclose floating hull cleaning equipment so that hull cleaning can take place in the water. These are complicated constructions, expensive to build and use, and do not allow routine boat maintenance at a typical dock or slip. Moreover, Seiple has no provision for avoiding pollution, and Feurt, although providing for the evacuation of contaminated water, does not prevent contaminates from escaping through the entrance and exit curtains.

To applicant's knowledge, applicant's prior U.S. Pat. No. 5,138,963 discloses the only method and apparatus that directly addresses the problem of cleaning a boat hull in the water and at a typical slip while avoiding pollution. Although the concepts disclosed in this earlier patent are still valid, the subject invention provides certain improvements.

SUMMARY

An apparatus and method are disclosed for cleaning a boat in the water while avoiding or minimizing pollution. Included are a floating, water-impervious basin and a filtration system. The basin has side walls sloped downwardly to a nadir spanning substantially the full length of the basin, an opening allowing the surrounding water to enter the basin as well as ingress and egress of boats, and a gate movable into a closed position over the opening and forming a cleaning chamber in the basin containing a pool of water. After the gate is closed behind a boat, the boat is floating in the pool of water that is now isolated from the surrounding water. As the gate is closing behind a boat, it allows water to pass therethrough to facilitate closure and to control the volume of water in the chamber, and yet is substantially sealed when closed. The filtration system includes a collector pipe lying submerged in the nadir and a pair of return pipes that float on the water in the basin. The sloped side walls and water exiting from the return pipes facilitate movement of materials resulting from the cleaning operation toward the collector pipe. The filtration system sucks the water-borne materials into the collector pipe, pumps them through a filter, and returns clean water to the basin through the return pipes. The relationship of the pipes and the basin facilitates reversibility of the basin so that its exterior surface may be periodically cleaned.

An object of the present invention is to clean a boat in the water without causing pollution.

Another object is to facilitate routine maintenance of a boat without causing pollution.

An additional object is to provide a closed system for cleaning the hull and other parts of a boat while in the water, wherein the substances removed from the boat and the materials used to remove them are collected and filtered out and are not allowed to escape into the surrounding water or air.

A further object is to provide a basin into which a boat is placed for cleaning, wherein the shape of the basin facilitates collection and removal of the substances cleaned off the boat and of the materials used to clean the boat.

Yet another object is to form a sheet of flexible waterproof material into a floatable, boat cleaning basin of desired shape, in which a boat may be placed for cleaning purposes, and which facilitates removal of contaminates that result from cleaning the boat in the water.

A still further object is to provide a collector that cooperates with the shape of a basin in which a boat may be cleaned while in the water for the purpose of facilitating the collection and removal of undesirable substances and cleaning materials.

Another object is to provide a boat cleaning apparatus that includes a cooperating pre-shaped basin and filtration system that facilitates movement of contaminated water and solid materials toward a collection area, collects contaminated water from the basin, and returns cleaned water to the basin.

An additional object is to provide a waterproof, floatable boat-cleaning basin that is made of flexible material, that can be configured to retain a desired shape under water and around the hull of a boat, and that resists billowing out of such shape by controlling the volume of water in the basin.

Another object is to provide a collector pipe for a boat cleaning apparatus that cooperates with the cleaning basin of the subject apparatus so that the pipe assists in maintaining the shape of the basin when a boat is floating in water within the basin.

A still further object is to return cleaned water to the pool of water in the cleaning basin of a boat maintenance apparatus so that the water is returned without causing undesirable turbulence in the pool.

An additional object is control the buoyancy of different parts of an apparatus for cleaning a boat in the water in order to control the positions of the parts and their interaction.

Yet another object is to provide a basin, a collector pipe, and return pipes used in a boat maintenance apparatus that cooperate to facilitate easy reversibility of the basin, so that both of its surfaces can be periodically cleaned.

Another object is to provide a gate for a cleaning basin of a boat cleaning apparatus wherein the gate is movable from an open position to a closed position, and while closing, releases water from the basin so as to assist in controlling the volume of water in the basin.

Still an additional object is to provide a gate for a cleaning basin of a boat cleaning apparatus wherein the end wall formed by the gate, and its opposite end wall in the basin, help to retain the desired shape of the basin during the boat cleaning operation.

Yet another object is to provide a boat maintenance apparatus that is adaptable for use by existing boat maintenance facilities so as to reduce the amount of pollution caused by such existing facilities during their boat maintenance operations; for boatyards that have slips used for boat maintenance; and for individual boat owners who desire to clean their own boats, especially routine maintenance on a more frequent basis.

An additional object is to provide a boat maintenance apparatus that is suitable for use with various sizes of boats and types of boats, including both powerboats and sailboats, and various sizes of docks and slips.

A further object is to provide a boat maintenance apparatus that is composed of parts that can be readily assembled and subsequently disassembled, and in the disassembled condition can be folded and otherwise arranged for transport and storage.

A still further object is to provide a boat maintenance apparatus that is resistant to the corrosive action and other adverse effects of seawater but may be cleaned or repaired if damage does occur.

These and other objects, features and advantages of the present invention will become apparent upon reference to the following description, accompanying drawings, and appended claims.

DESCRIPTION OF THE DRAWINGS

FIG. 1 shows the collector and return pipes of the filtration system removed from the basin and in resting positions on the dock and further shows the gate of the basin floating in an open position.

FIG. 9*a* is an enlarged fragmentary section taken on-line 9*a*—9*a* in FIG. 9.

FIG. 9*b* is an enlarged fragmentary section taken on line 9*b*—9*b* in FIG. 9.

DETAILED DESCRIPTION

Figure 1:
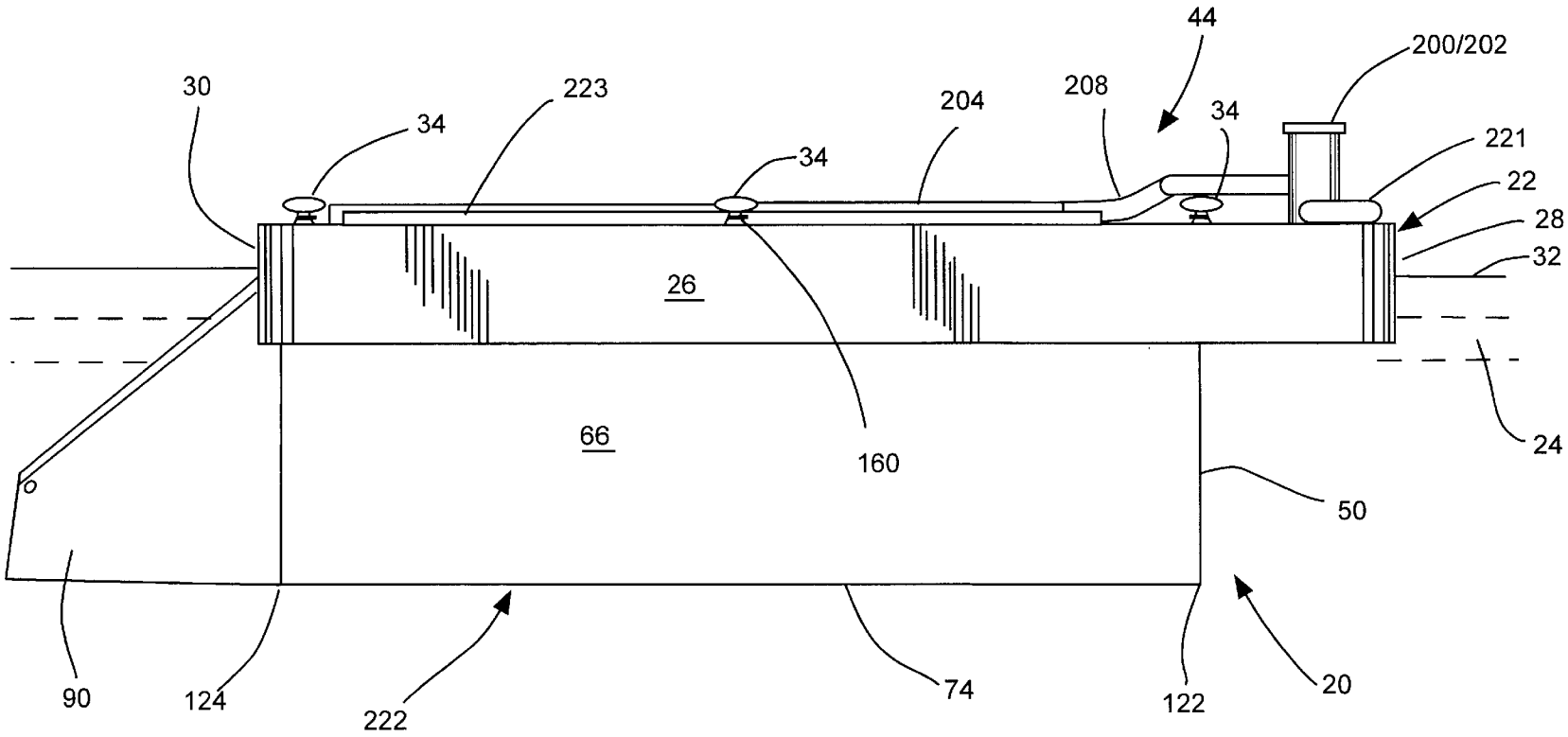
FIG. 1 is a side elevation of an embodiment of the subject boat maintenance apparatus floating in a floating dock, the apparatus including a cleaning basin and a filtration system.

The number 20 in the drawings generally indicates an embodiment of a boat maintenance apparatus for cleaning the hull and other parts of a boat. The apparatus may be supported in the water from a dock or slip 22, or other suitable structure. As shown, the dock is floating in seawater 24 and is U-shaped having spaced side portions 26, a closed forward portion 28, and an open aft end 30. Notwithstanding the reference to "seawater," it is understood that the subject invention is not limited to use in seawater but may be used in bodies of fresh water, although it is more likely to be used in cleaning boats that have been subjected to the effects of seawater. For purposes of subsequent reference, the level of the water outside of the apparatus is indicated by the number 32. The dock is provided with a plurality of cleats 36 spaced along the side and rear portions. With particular reference to FIGS. 1–6 and 10, the subject boat maintenance apparatus 20 includes a cleaning basin 42 and a water filtration system 44. Each of these main components of the subject apparatus will now be described in detail.

The basin 42 (FIGS. 7–9) is made of sheet material that is flexible, durable, chemically and ultraviolet resistant, waterproof or impervious, relatively lightweight, and resistant to algae and other corrosive and deteriorating effects of seawater. Development of the subject apparatus indicates that vinyl sheet of the type used for lining swimming pools is very suitable for the purposes of the present invention. More particularly, thirty-mil vinyl sheet sold under the trademark Plastimayd by the Plastimayd Corporation of Clackamas, Oreg., 97015, has been successfully used for the subject basin. It should be understood, however, that there are many other sheet materials having the foregoing qualities that would be suitable for the subject basin, and thus the invention is not limited to the Plastimayd sheet. In general, my development indicates that sheet material of the foregoing qualities of a thickness in the range from about thirty mils to about forty mils is preferable for the subject basin. Moreover, for a basin to be used in a dock having a length of about forty-eight feet and an opening of about eighteen feet, a basin made of the Plastimayd sheet will weight approximately two hundred-fifty pounds, a weight that can be handled by one person. Sheet materials that result in much greater weight could be used but because of the handling problem, are not preferred.

Figure 8:
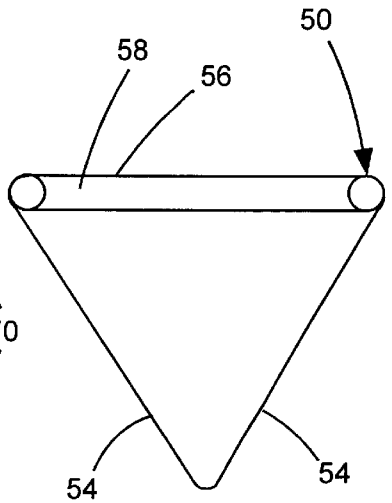
FIG. 8 is a plan view of the end sheet constituting the end wall of the basin of the subject apparatus prior to its assembly with the main sheet shown in FIG. 7.
Figure 7:
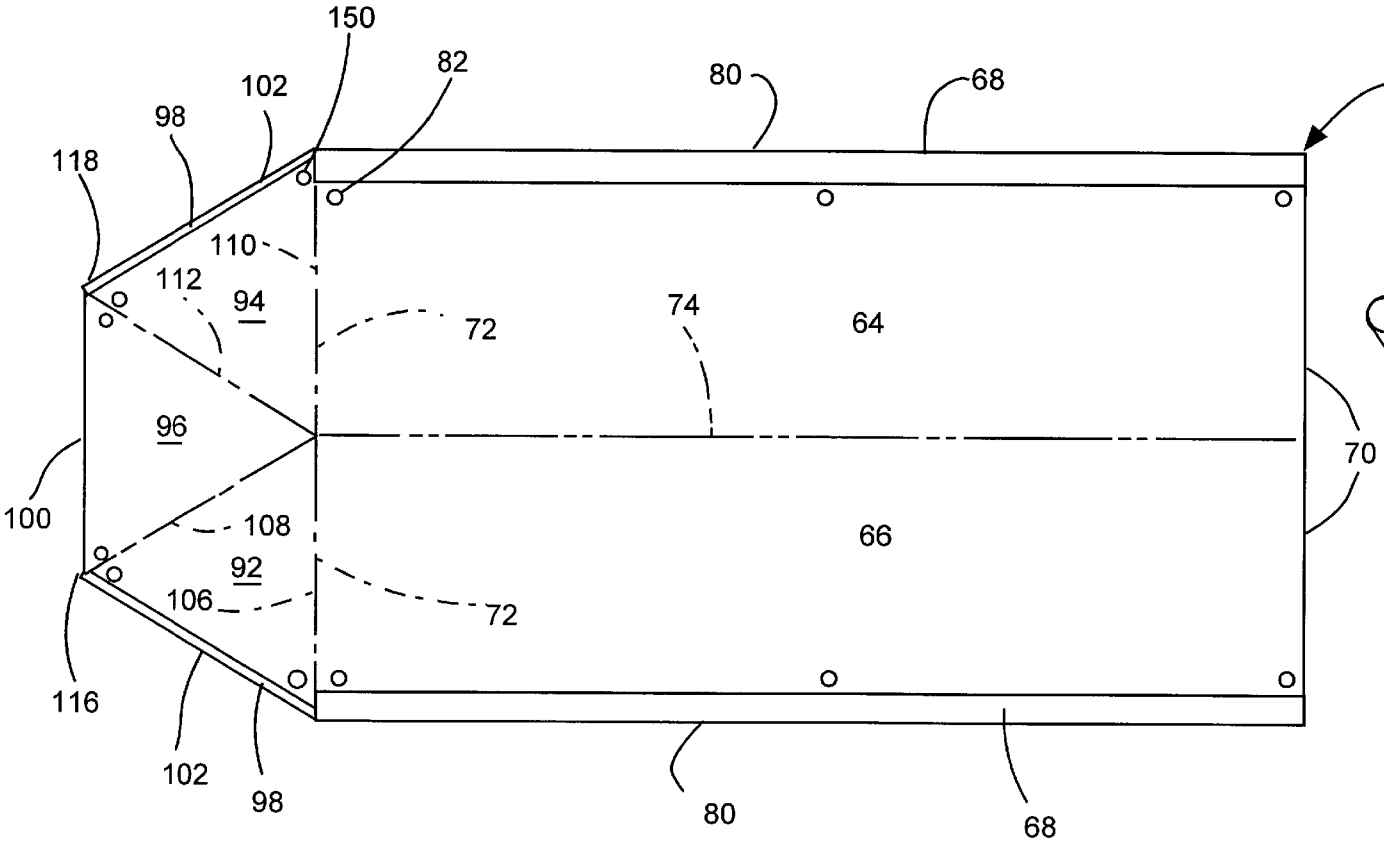
FIG. 7 is a plan view of the main sheet from which the side walls and gate of the basin of the subject apparatus are formed, it being noted that, except for rolled sleeves at several edges, this sheet is lying flat with the side walls and gate being in a common plane.
Figure 9:
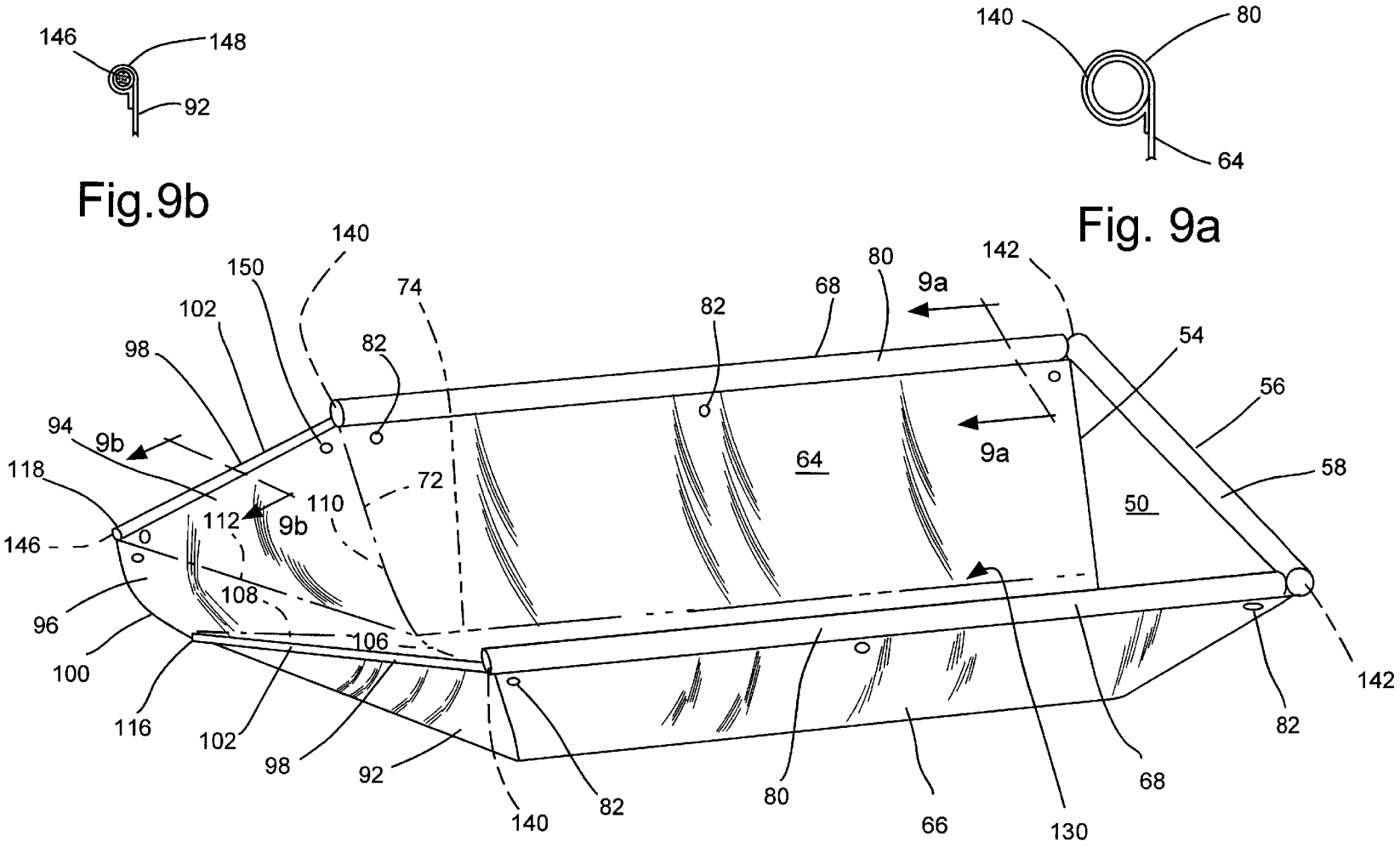
FIG. 9 is an isometric view of the main and end sheets assembled into the basin of the subject apparatus showing the gate in an open position.

With continued reference to FIGS. 7–9, the basin 42 is formed from an end sheet 50 and a main sheet 52 of the selected material. The end sheet or piece is planar and in the shape of an equilateral triangle having side edges 54 and an upper edge 56. The end sheet constitutes the end wall of the basin and for simplicity is given the same reference numeral, namely 50, as the end wall The upper edge of the end wall is formed with a sleeve 58 along its length.

The main sheet 52 is also shown in its flat planar condition in FIG. 7. Although this main sheet is formed into a V-shape, it will first be described in its flat condition so as to enable a better understanding of how the basin is formed. In its flat condition, the main sheet may be thought of as being divided into the various walls or panels of the basin into which it will be formed, it being understood that in the preferred embodiment, these walls and panels are not delineated on the sheet, although for descriptive purposes, they are so illustrated in the drawings. Thus, the sheet has rectangular, planar port and starboard side walls 64 and 66 with each sidewall having an upper edge 68, a forward end edge 70, an aft end edge or fold line 72, the later being shown in dashed lines to indicate that it is merely an eventual fold line in the sheet. The side walls meet along a central juncture or eventual fold line 74 that extends from one end edge 70 to the other end edge 72 of the panels. The end edges 70 and 72, the upper edge 56, and the side edges 54 are all of equal length. In addition, the upper edges 68 and the juncture 74 are of equal length.

Sleeves 80 (FIGS. 7–9) are provided along the upper edges 68 of each side wall 64 and 66, extending from end to end of the upper edges. In addition, grommets 82 are provided in the side walls in inwardly adjacent relation to the sleeves at the forward and aft comers and centrally therebetween.

The main sheet 52 of the basin 42 also includes a gate 90 (FIGS. 7 and 9) that extends rearwardly from the side walls 64 and 66 and is planar with the side walls when the sheet is laid out flat as shown in FIG. 7. As with the walls 64 and 66, the main sheet may be thought of as having port and starboard panels 92 and 94 and an intermediate panel 96 between the port and starboard panels. The port and starboard panels have outer edges 98 equal in length to the length of the edges 54, 56, 70 and 72. The intermediate panel also has an outer edge 100 of this same length and which joins the outer edges 98 of the port and starboard panels. Sleeves 102 of smaller diameter than the sleeves 58 and 80 are formed in the outer edges 98.

With continued reference to FIGS. 7, 8 and 9 and, the main sheet 52 is initially folded along the juncture 74 to bring the side panels 64 and 66 into a V-shaped relationship to each other. It is to understood that because of the sheet material used, such folding produces merely rounding along the juncture as opposed to creasing. The end sheet or wall 50 is assembled with the folded main sheet so that the side edges 54 mate with the forward end edges 70 and the upper edge 56 spans the distance between the forward ends of the upper edges 68. The end and side walls are then hot sealed together in this assembled relationship, as best seen in FIG. 9, wherein the end wall maintains the side walls in the V-shaped relationship, although with the gate 90 open and the basin 42 not confined within the dock 22, as shown in FIG. 9, the side walls may diverge rearwardly somewhat towards the gate. When the gate is closed, however, in a manner to be described, and as shown in FIGS. 5, 6, 12 and 15, for example, the complete basin 42 is formed with the gate having the same triangular shape and size as the end wall 50.

To describe the closing of the gate 90, reference is initially made to FIG. 7. There, it will be seen that the starboard and port panels 92 and 94 have imaginary first and second fold lines respectively 106, 108, 110 and, 112. All of these fold lines as well as the center fold line or juncture 74 of the panels intersect at a point 114. The first fold lines 106 and 110 of the starboard and port panels are collinear, whereas the second fold lines 108 and 112 extend from the intersection point 114 rearwardly to the aft ends or corners 116 and 118 on the starboard and port panels, respectively.

Closing of the gate 90 may be initiated at either the starboard or the port panel 92 or 94 (FIGS. 7 and 9). Assuming that closing of the gate is initiated with the starboard panel, the corner 116 of the starboard panel is brought transversely of the basin 42 to the aft end of the upper edge 68 of the port side wall 64. In so doing, the gate folds along the first fold line 106 and the second fold lines 108 and 112. This causes the intermediate panel 96 to be brought into substantially parallel relation with the port panel 94 and the starboard panel 92 to be brought into parallel relation with the end wall 50. It is to be noted that the folds along the first fold line 106 and the second fold line 112 project outwardly of the basin, whereas the fold along the second fold line 108 projects inwardly of the basin. In other words, the second fold line 108 is brought into substantially parallel, adjacent relation to the first fold line 110.

Closing of the gate (FIGS. 7 and 9) is completed by bringing the now adjacent and parallel port and intermediate panels 94 and 96 transversely forwardly up into adjacent parallel relation against the starboard panel 92, with the folding action occurring along the second fold line 108 and the first fold line 110 so that the first fold line 106 and the second fold line 112 are now in adjacent parallel relation to each other. The gate is then held in this closed position in a manner to be described thereby forming the basin into a polyhedral, trough shape, or what may be visualized as an inverted tent.

With the basin 42 (FIGS. 4–6) formed in the manner described above and understanding that the basin is used in a horizontal upwardly open orientation, the side walls 64 and 66 converge or slope downwardly to the juncture 74 which constitutes a nadir at the bottom of the basin. Moreover, the side and end walls 64, 66 and 50 meet in a lower forward tip 122, the side walls and the gate 90 meet in an aft tip 124, with the nadir extending the full length of the basin between these tips, and the end wall and the gate are in opposed parallel relation to each other. In the closed position of the gate, the basin provides a chamber 130, which is substantially sealed by the integral association of the end and side walls and because of the folded relationship of the panels 92, 94 and 96 of the gate.

Hollow side and end flotation tubes 140 and 142 are fitted in the side and end sleeves 80 and 58, respectively, of the basin 42, and have their ends capped. These tubes are preferably made of PVC flotation pipe (FIG. 5A) of sufficient diameter to provide positive buoyancy in order to support the basin 42 in the water. On the other hand, flotation tubes 146 (FIGS. 9, 9A) are fitted in the sleeves 102 of the port and starboard panels 94 and 92 but are filled with lead shot 148, and their ends capped, in order to provide these tubes with a measure of negative buoyancy, for a purpose to be described. Still further, grommets 150 are provided in the port, starboard and intermediate panels 94, 92, 96 adjacent to corners 116 and 118 and the fold lines 106 and 110.

The basin 42 is fitted within the slip of the dock 22 as best seen in FIGS. 2, 3, 5, 6, 13 and 15. It will thus be understood that the sheets 50 and 52 from which the basin is constructed are dimensioned so as to fit the basin within the slip and that these dimensions may be varied to fit slips of various sizes. That is, as fitted in the slip, the end wall 50 and the upper edges 68 of the side walls 64 and 66 are in closely adjacent spaced relation to the front and sides 28 and 26, respectively, of the dock. Furthermore, the common aft end edge 72 of the side walls is in substantial alignment with the opening 30 in the dock so that when the basin is fully within the dock, the gate 90 in its open position extends rearwardly from the dock, as best seen in FIGS. 1, 2, 10 and 13. Because of the flotation tubes 140 and 142 as well as the sheet material from which the basin is made, the basin floats within the dock and is moveable upwardly and downwardly in the water relative to the dock.

Because of the negative buoyancy of the flotation tubes 146, however, the gate 90 in its open position extends downwardly and rearwardly from the aft end of the dock as seen in FIGS. 1, 3, 10 and 13. The buoyancy of the flotation tubes is adjusted by adding more or removing some of the lead shot 148 in the tubes so as to maintain the gate at the desired downwardly sloping angle in its open position. In other words, the gate must extend rearwardly and downwardly in order to allow entry and egress of boats into and out of the basin 42 without the keel, the rudder or propeller of a boat becoming fouled with the basin. Furthermore, the gate must not hang vertically downwardly from the dock since this will tend to lift the sidewalls 64 and 66 upwardly, again causing interference with the boat. Tie lines 160 (FIGS. 2, 3, 5, 6, 15 and 16) extend through the grommets 82 in the basin and are fastened around the cleats 34 thereby tethering the basin to the dock while allowing relative vertical movement of the basin and the dock.

Figure 2:
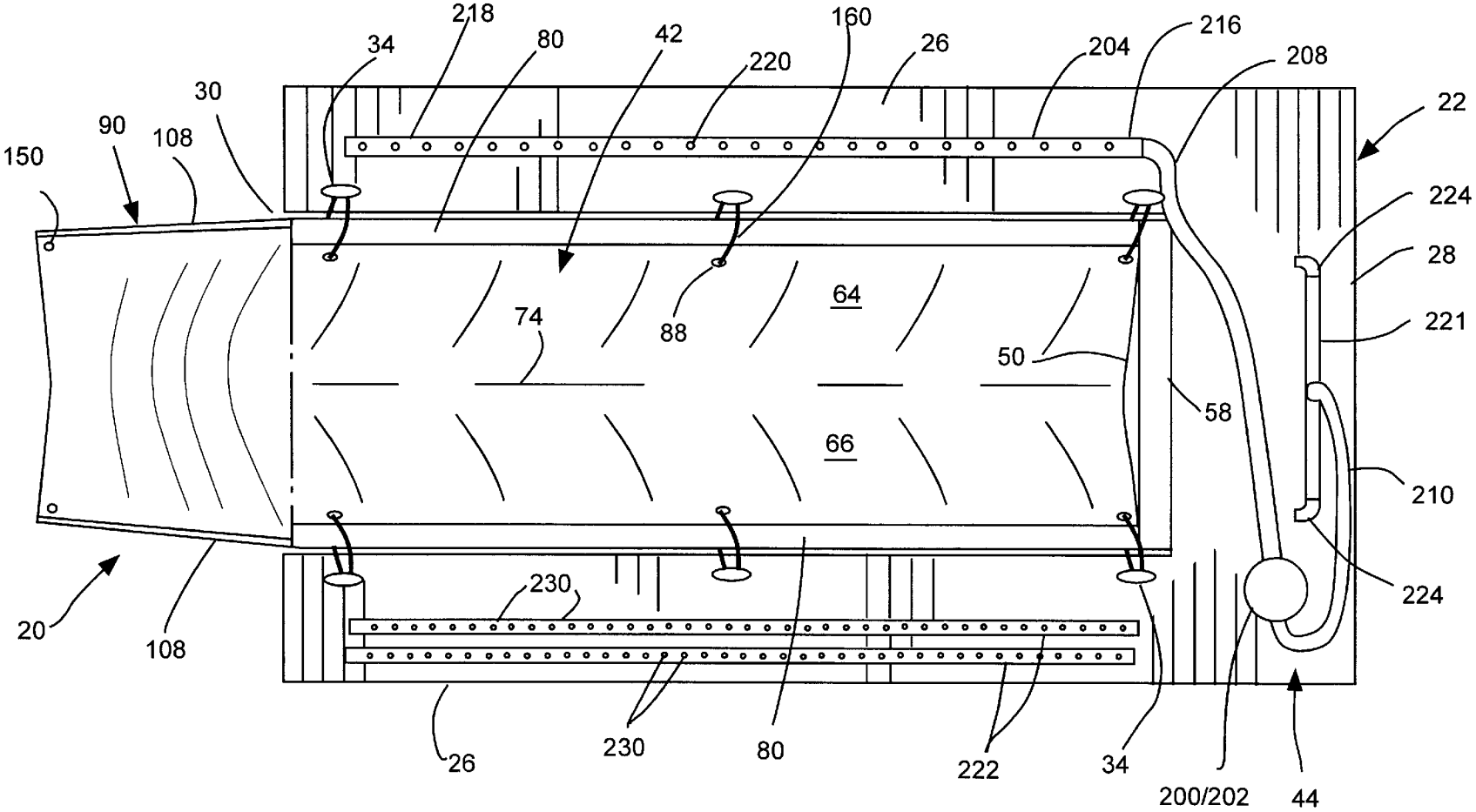
FIG. 2 is a top plan view of the apparatus and dock shown in FIG. 1.
Figure 3:
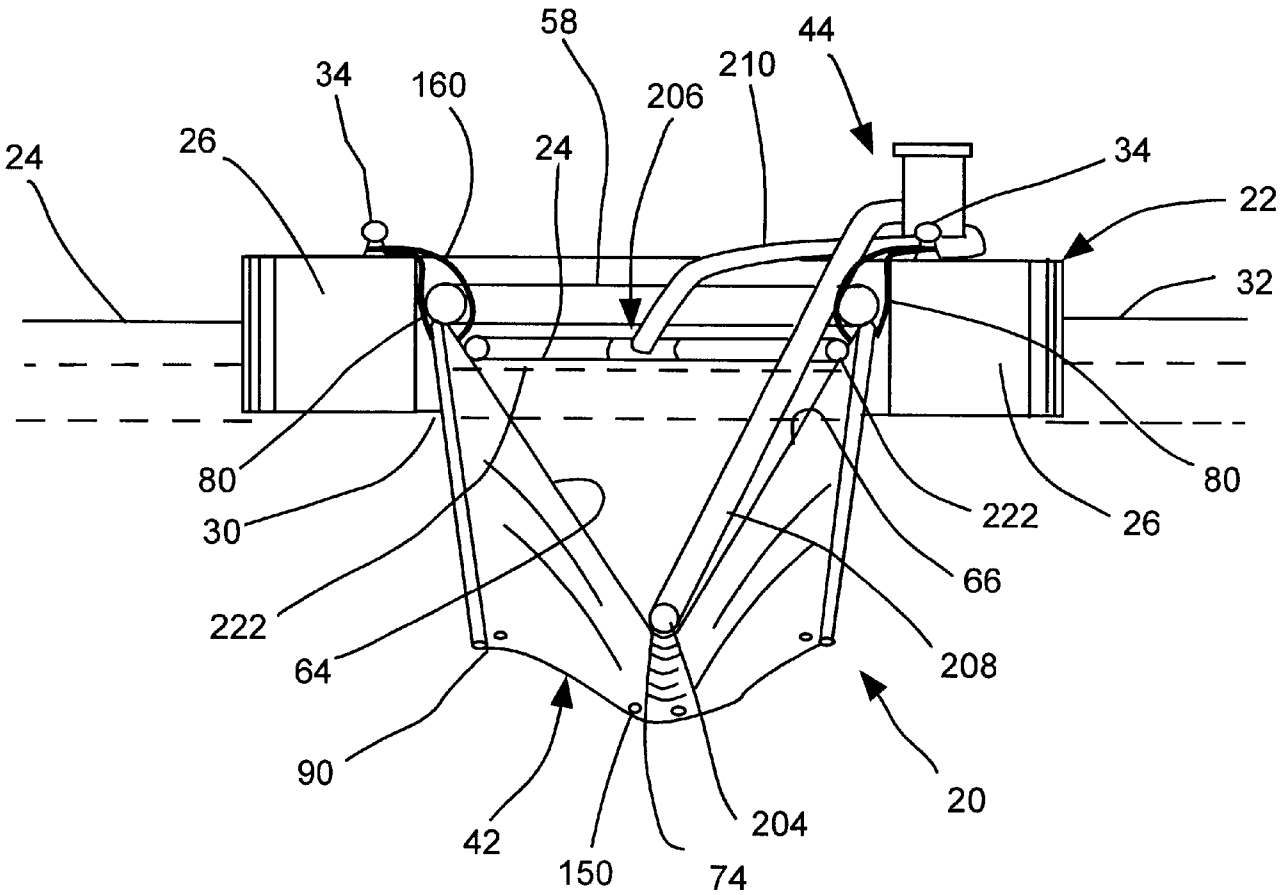
FIG. 3 is an end elevation of the apparatus and the dock as viewed from the left end of FIGS. 1 and 2 but with the collector and return pipes shown in their operating positions in the basin.
Figure 4:
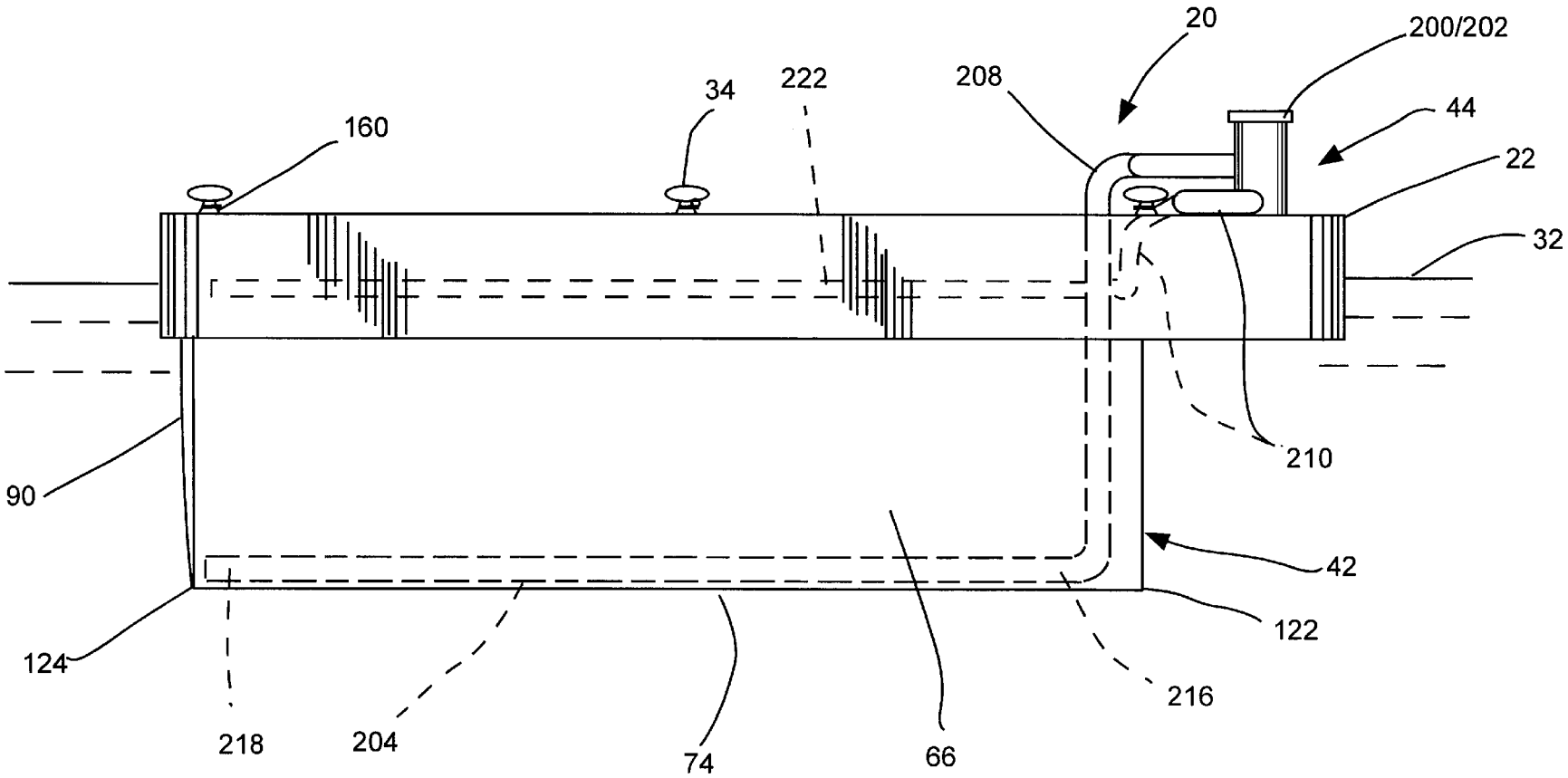
FIG. 4 is a view similar to FIG. 1 but with gate closed and the collector and return pipes in their operating positions.

As thus floating and tethered, the side and end walls 64, 66 and 50 of the basin 42 extend downwardly from the dock 22 with the side walls in the previously described V-shaped relationship. The construction of the basin 42 in the manner described above is accomplished so as to provide an angle of decline or slope of the side walls that is from about forty-five degrees to about sixty degrees to the horizontal. With the gate 90 open, as shown in FIGS. 1, 2 and 3, for example, water of course enters the basin from the surrounding sea water 24. The trough-like or inverted tent shape of the basin results from the construction of the basin, as above described, but also because the weight of the water within the basin tends to maintain this shape, as long as the weight of the water does not exceed certain limits, as further described below.

With the gate 90 in closed position (FIGS. 5, 12 and 15), the end and side walls 50, 64 and 66 and the gate form the closed working or cleaning chamber 130 previously described. Moreover, when the gate closes, it captures a pool 170 of water in the chamber having a water level 172 very close to but below the upper edges 56 and 58 of the basin including the gate. Since the forward end wall 50 is integral with the side walls, no water can escape from the forward end of the basin. In addition, because of the folded panels 92, 94 and 96 of the gate, the gate essentially seals the aft end of the basin so that no water can escape through this route (FIG. 12A).

In order to limit the amount of water that is retained in the pool 170, the gate 90 allows water to exit from the basin 42 while the gate is being closed. More specifically, with reference to FIGS. 10, 11 and 12, the steps of closing the gate are further described. When the starboard corner 116 is brought up to the aft end of the port sleeve 80, a passageway 180 is formed between the intermediate and port panels 96 and 94, allowing water to escape from the basin into surrounding sea water as indicated at 182 (FIG. 11). When the port and intermediate panels are folded up against the starboard panel 92, as shown from FIG. 11 to FIG. 12, water is allowed to escape at 184 from between the intermediate and starboard panels. How this latter escape of water occurs can also be visualized by reference to FIG. 12A. Thus, by limiting the volume of water in the basin and by allowing the basin to float within the dock 22, the pool 170 of water effectively maintains the V-shape of the basin without causing the basin to balloon or billow outwardly and downwardly as might occur if the upper edges 56 and 68 of the basin were securely tied by the lines 160 to the cleats 34. Even if the basin sinks down far enough to place the tethering tie lines 160 under tension, the flotation tubes 140 and 142 have a tendency to yield somewhat and counteract a tendency of the basin to balloon in the water out of its desired shape. Of course, another reason for maintaining the level 172 of the pool 170 below the upper edges of the basin is to isolate the pool 170 from the surrounding sea water.

The downwardly sloping, planar walls 64 and 66 of the basin 42 (FIGS. 3, 6, 9, 16) of the present invention are to be contrasted with the concave, rounded shape of the walls of the bag of my prior U.S. Pat. No. 5,138,963. As will be described in more detail subsequently, the side walls of the basin of the present invention are sloped at favorable angles directed toward the juncture 74, which is at the nadir of the bottom of the basin, in order to allow substances that settle on the side walls to gravitate toward the nadir.

Figure 5:
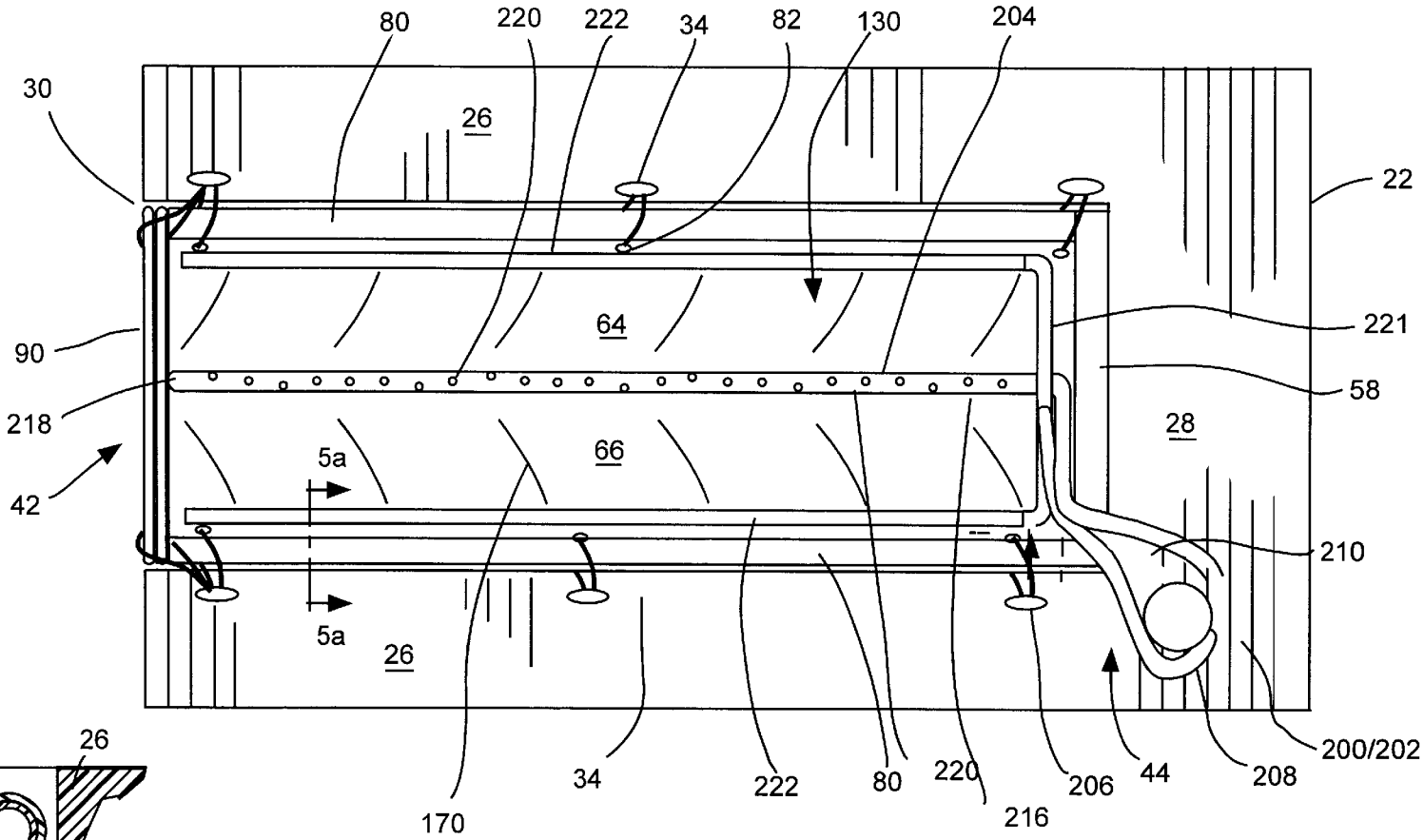
FIG. 5 is top plan view of the apparatus and dock shown in FIG. 4.
Figure 5A:
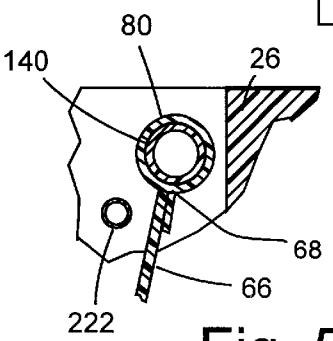
FIG. 5*a* is a somewhat enlarged, fragmentary section taken on line 5*a*—5*a* in FIG. 5.
Figure 6:
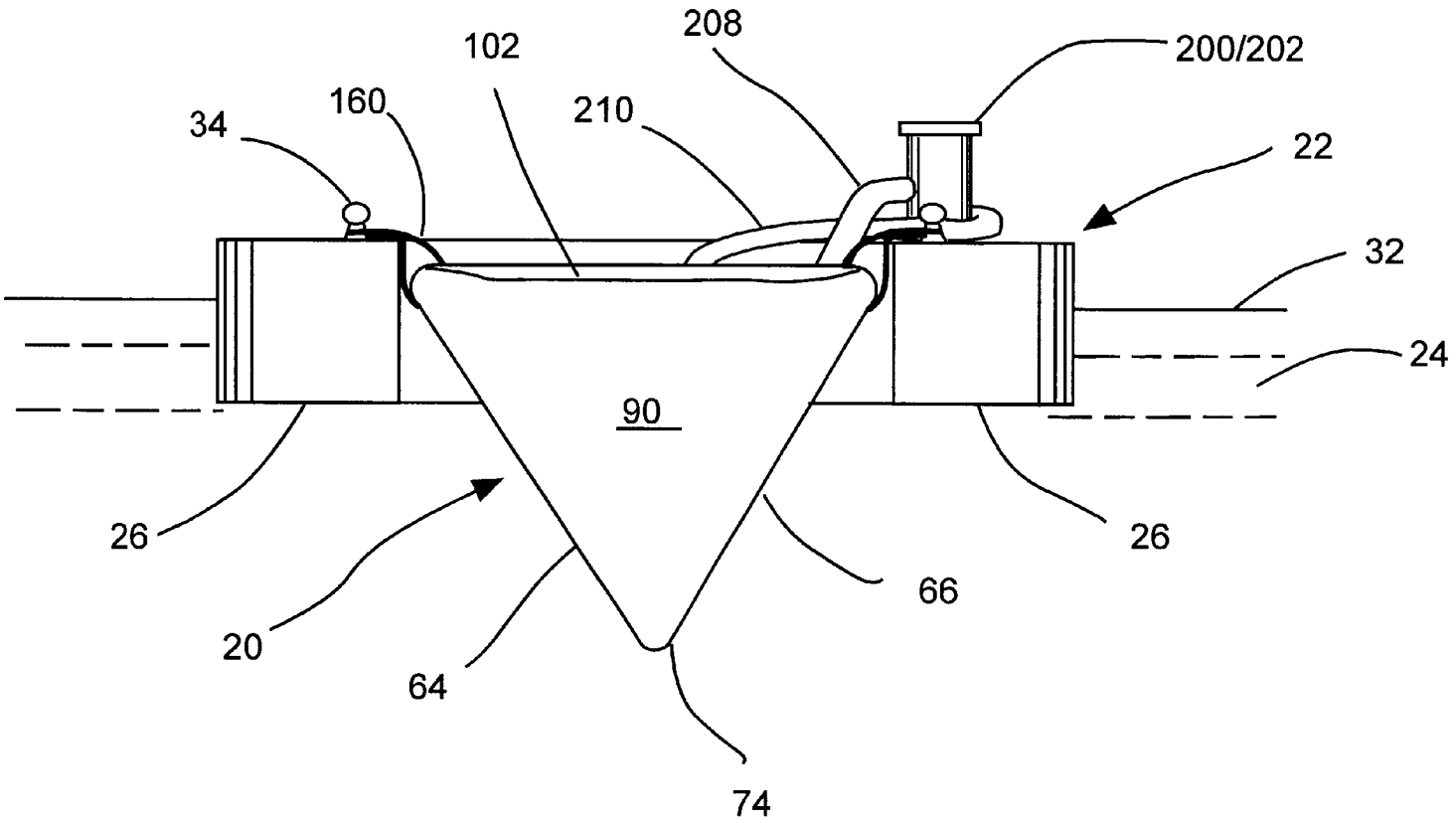
FIG. 6 is an end elevation of the apparatus and dock shown in FIGS. 4 and 5 as viewed from the left end of FIGS. 4 and 5.

The water filtration system 44 (FIGS. 5, 13, 15 and 17) of the subject apparatus 20 includes a pump 200, a filter 202, a collector pipe 204, return piping 206, an collector hose 208 interconnecting the collector pipe and the pump, and a return hose 210 interconnecting the filter and the return piping. The collector pipe is elongated and perforated having a forward end 216, an aft end 218, and provided with a plurality of apertures 220 along its full length from the forward end to the aft end. The length of the collector pipe is approximately the same as the length of the juncture or nadir 74 in the basin 42 and lies along this nadir with the forward end 216 adjacent to the forward end wall 50 and the aft end adjacent to the gate 90. As positioned in the basin, the apertures of the pipe are directed upwardly and preferably also laterally, as shown in FIG. 5. The collector pipe may be made of plastic, metal, a composite or other suitable material.

The collector pipe 204 is merely rested in the nadir 24 of the basin 42 but is not attached to the basin. As such, the collector pipe can readily be moved from its operating position in this nadir, as shown in FIGS. 4–6 and 13–16, into a displaced position on one of the side portions 26 of the dock 22, as shown in FIGS. 1–3. The collector pipe has sufficient weight so that when it is located on and in the nadir of the basin, it remains in that position and helps to hold the basin in its V-shaped or trough configuration, as discussed above. The return piping 206 (FIGS. 5, 13, 15 and 17) includes a forward, floatable manifold 221 having a diameter approximately the same as the collector pipe 204 and floating on the pool 170 of water in the chamber 130 in adjacent spaced relation to the forward end wall 50 of the basin and with its opposite ends in adjacent spaced relation to the upper edges 68 of the side walls 64 and 66. Elongated floatable lateral return pipes 222 are individually connected by quick connect swivel couplings 224 to the ends of the manifold and have capped aft ends. The manifold and the return pipes are made of PVC flotation pipe so that the return piping readily floats on the surface 172 of the pool 170. The return pipes are of a diameter less than that of the manifold or the collector pipe and have inwardly and downwardly directed apertures 230 along the entire length of each return pipe. The length of the return pipes is approximately the same as the length of the basin so that the aft ends of the return pipes are adjacent to gate 90. Also, the length of the manifold is such that the U-shaped return piping fits within the upper portion of the basin 42 with the return pipes in adjacent spaced relation to the side walls 66 and 64 and so that the return piping may float up and down within the basin a limited distance without necessarily resting on the side walls.

Figure 17:
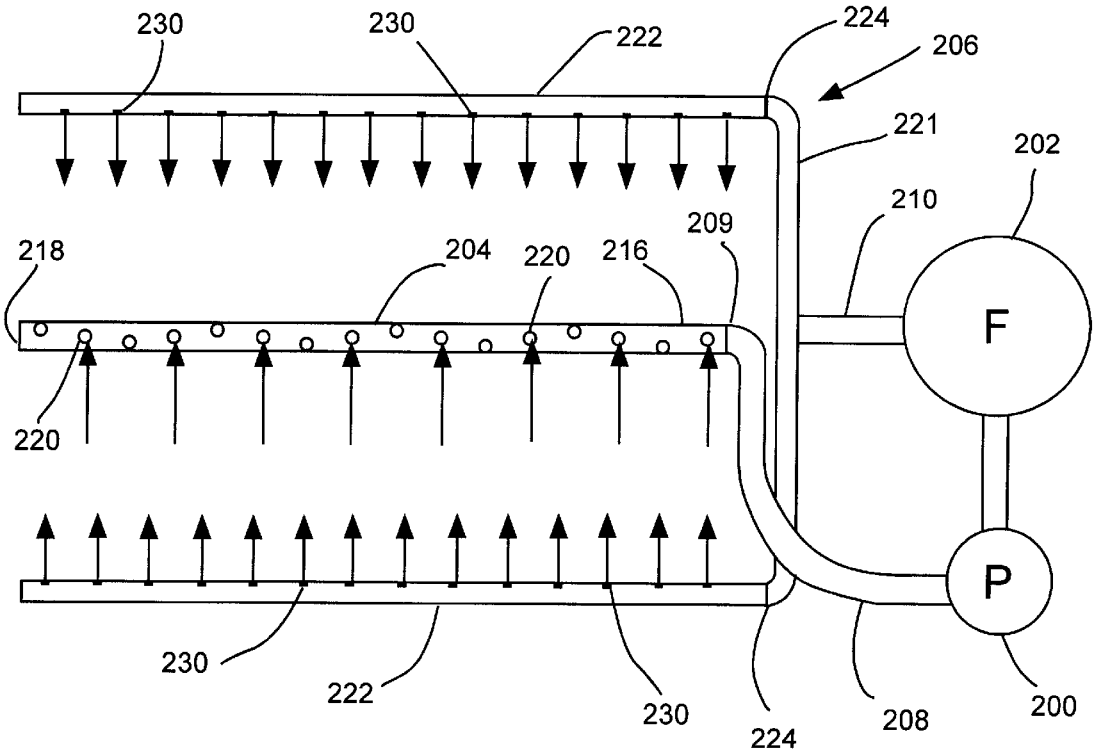
FIG. 17 is schematic diagram of the filtration system used in the apparatus of the present invention.

With reference to the hydraulic filtration circuit shown in FIG. 17, the collector hose 208 connects the forward end 216 of the collector pipe 204 to the inlet of the pump 200, and the return hose 210 connects the outlet of the filter 202 to the manifold 221 intermediate the ends thereof. It will thus be understood that with the pump operating, water and water borne contaminants are sucked through the apertures 220 of the collector pipe 204, drawn by the pump into the filter, and forced by the pump through the filter wherein contaminants are removed from the water. Clean water exits through the return hose into the manifold where it passes into the return pipes and from there through the apertures 230 back into the pool. The apertures in the return pipes are directed downwardly and slightly inwardly over the sloping side walls 64 and 66 and create a gentle downwardly directed current causing the solid materials in suspension in the pool to gravitate downwardly onto the side walls and thence downwardly toward the collector pipe. The apertures 230 in the return pipes are of smaller diameter than the apertures 220 in the collector pipe and are more numerous than the apertures in the collector pipe. Thus clean water is returned to the pool in a gentle shower from each of the return pipes rather than in a higher velocity jet that would emanate from a single return pipe, the later causing turbulence in the water which would counteract the natural tendency of particulants in the pool to gravitate onto the side walls.

Because the both the collector pipe 204 and the return piping 206 are not attached to the basin, they may be readily manually lifted from their operating positions into resting positions on the dock 22, as illustrated in FIGS. I through 3. This construction allows the basin to be easily reversed in order to keep both the inside and the outside surfaces of the basin clean. By reversal of the basin is meant to remove the basin from the dock by untying the lines 160 and 270, turning it inside out so that the surface of the basin that previously faced downwardly in the water will now face upwardly into the chamber. Since there is no outlet cut in the bottom of the basin or associated fitting, as provided in my prior U.S. Pat. No. 5,138,963, and since the pipes 204 and 205 are removable as described, the reversal of the basin is greatly facilitated. As will be understood, the basin is symmetrical irrespective of which surface faces up and, as above noted, has sufficient flexibility to allow it to be turned inside out as it is being reversed, and is light enough to be handled for this purpose. Moreover, this reversal may be accomplished whether the gate 90 is open or closed. Once the basin has been reversed, it is again placed within the dock, tethered thereto by the lines 160, and both the collector pipe 204 and the return piping 206 are returned to the positions previously described.

OPERATION AND DESCRIPTION OF THE METHOD

Figure 14:
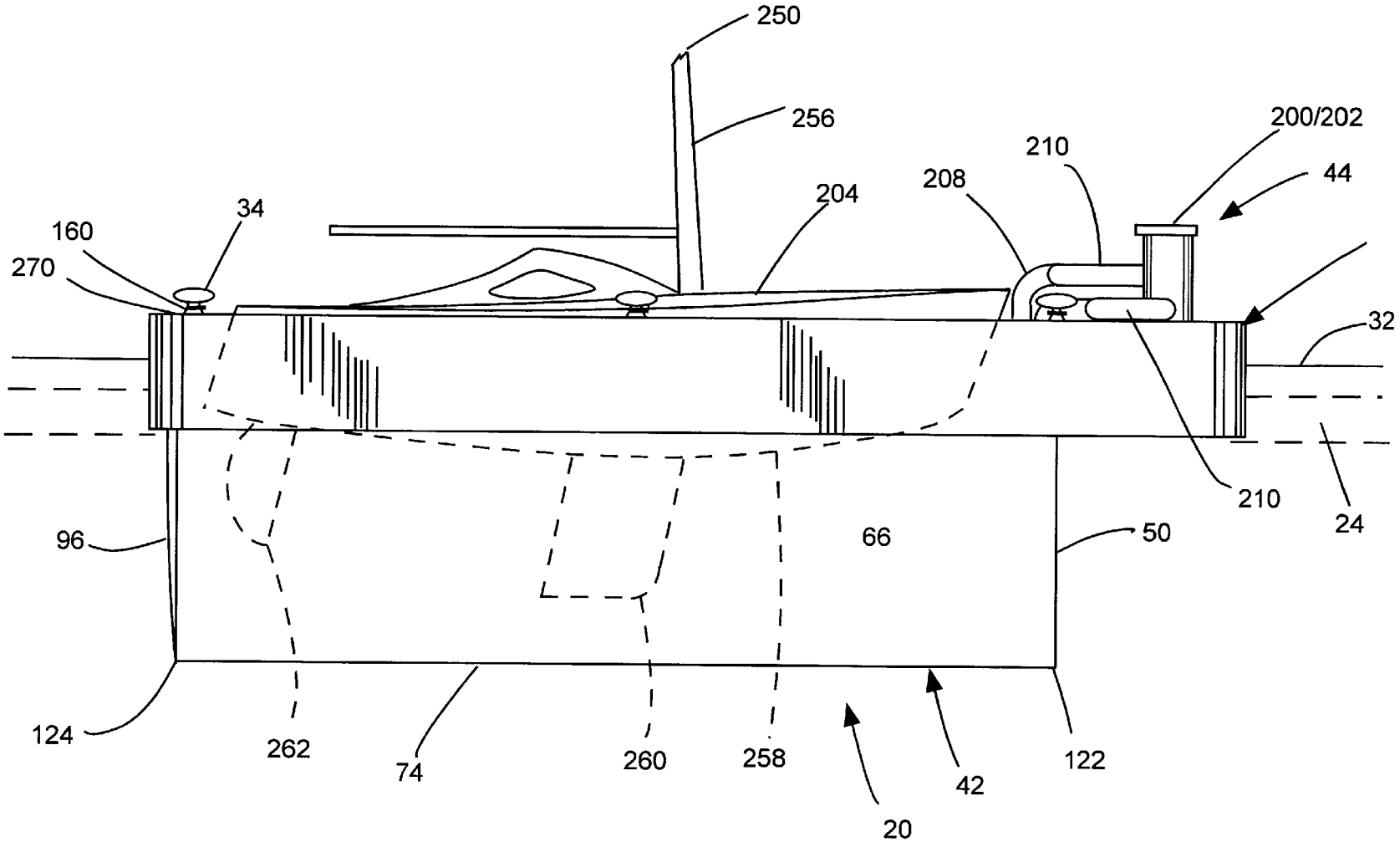
FIG. 14 is a side elevation of the subject apparatus and dock, showing the gate in closed position and a boat floating in the pool of water in the basin.
Figure 15:
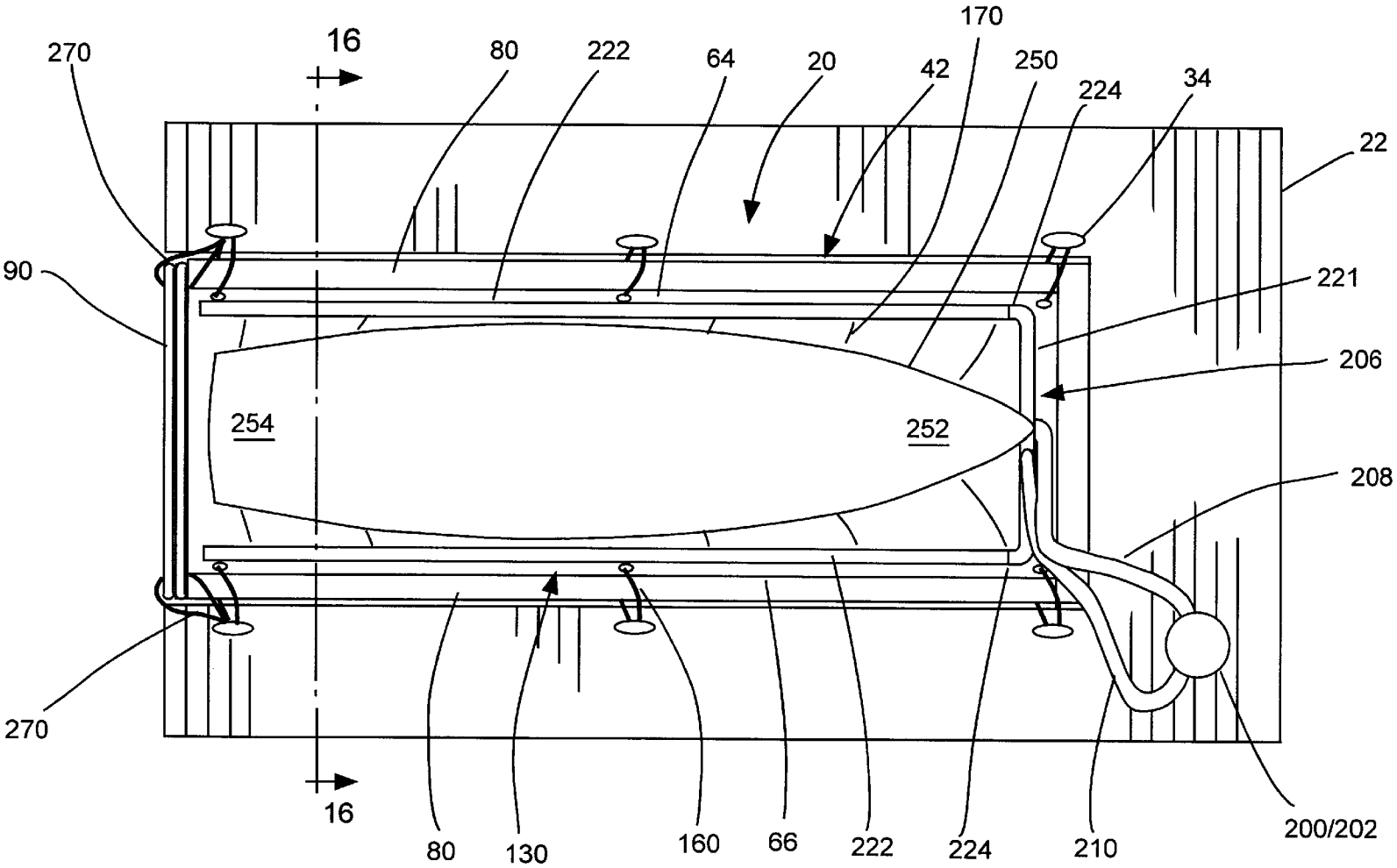
FIG. 15 is a top plan view of the floating dock, the basin floating in the dock, and the boat floating in the basin, it being noted that the superstructure of the boat of FIG. 14 is omitted for simplicity and to indicate that boats of various types may be serviced in the subject apparatus, and it being further noted that return piping is shown floating both port and starboard and forward of the boat.
Figure 16:
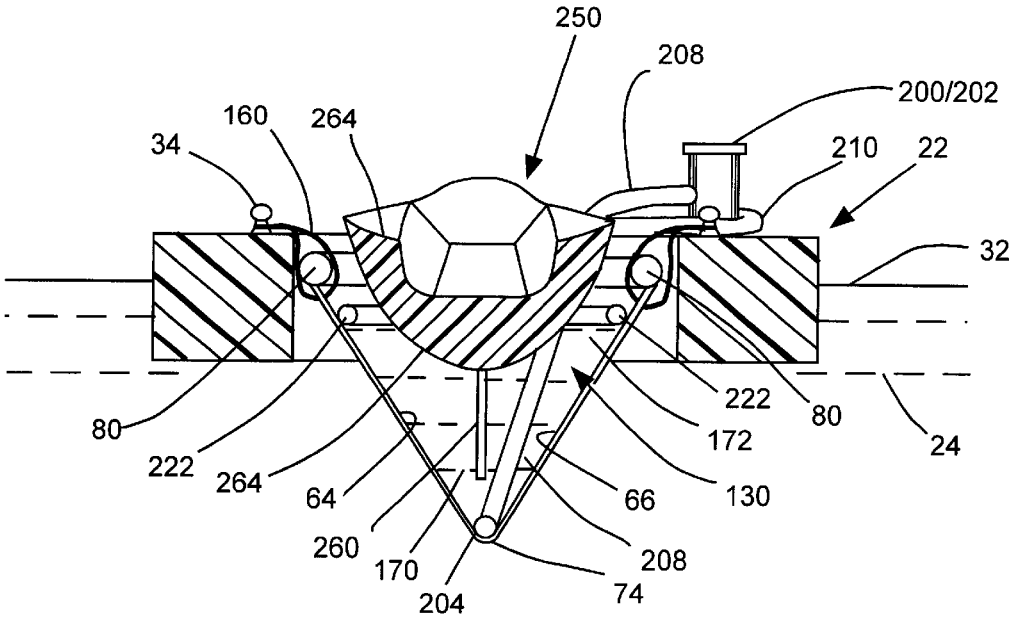
FIG. 16 is a transverse vertical section taken on line 16—16 in FIG. 15.

As previously indicated, the subject boat maintenance apparatus 20 may be used to clean or otherwise maintain or service various types of boats, but a sailboat 250 is generally shown in FIG. 14 to illustrate how the subject apparatus may be used. Although the apparatus is ideally suited for boat cleaning purposes, other types of service or maintenance may readily be accomplished, such as under-hull or keel inspections or servicing the engine for example. For convenient reference, the boat shown has a bow 252, a stern 254, a mast 256, a hull 258, a keel 260, a rudder 262, and a deck 264.

Figure 10:
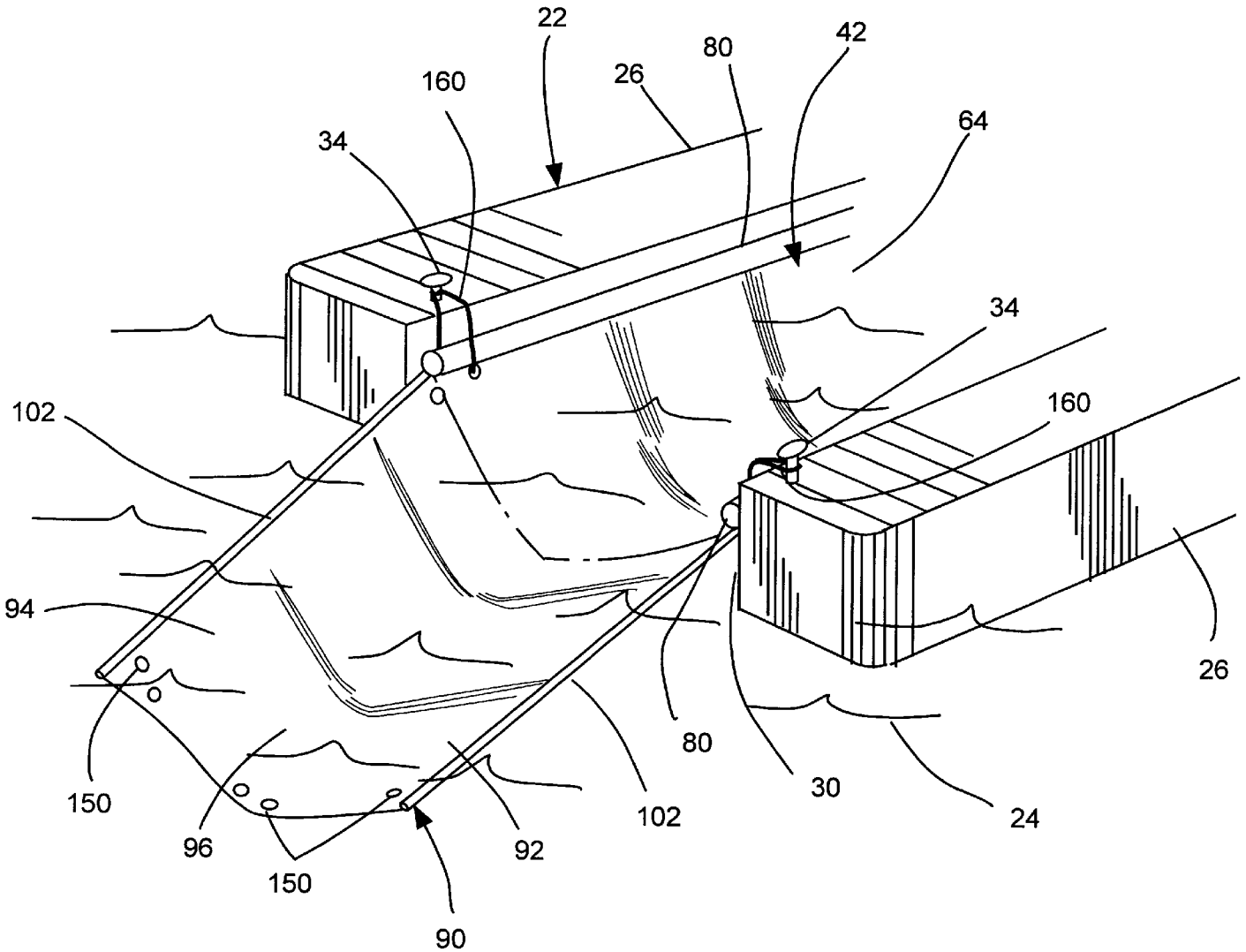
FIG. 10 is a fragmentary perspective view of the dock and basin showing the gate in open position, it being noted that the collector and return pipes are omitted for clarity.
Figure 11:
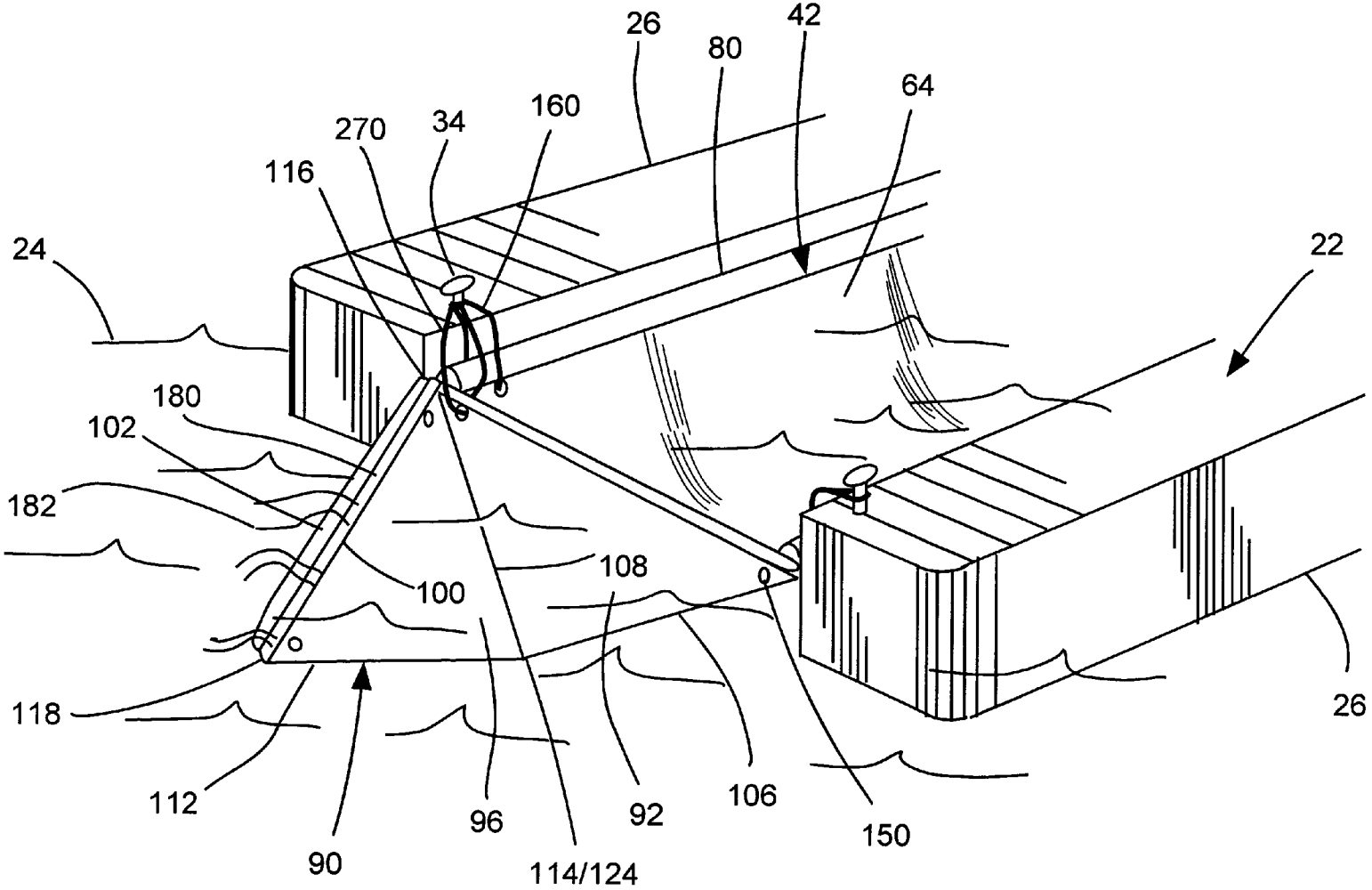
FIG. 11 is a view similar to FIG. 10 but showing the gate in a partially closed position, that is, showing the gate as it is being moved from its open position into its fully closed position wherein water in the chamber of the basin is allowed to escape into the surrounding water through a passageway between the panels of the gate.

Assuming that the basin 42 is suspended and floating within the dock 22, that both the collector pipe 204 and the return piping 206 are placed in their operating positions, and that the boat 250 is to be cleaned, the gate 90 is opened as seen in FIGS. 1–3, 10 and 13. In its open position, the gate extends downwardly and rearwardly from the dock, as shown in FIG. 1, and is maintained in this attitude by the negative buoyancy of the flotation tubes 146 in the gate. The boat 250 is then moved into the basin over the open gate without the keel or rudder becoming fouled with the gate or the bottom of the basin since the gate is maintained at an appropriate sloping position below such parts of a boat. After the boat is completely within the basin, the gate is closed by manually handling the sleeved flotation tubes 146 and folding the panels 92, 94, and 96 together in the manner previously described. It is to be understood at this point that either the port panel or the starboard panel may be initially brought toward its kitty-corner aft end of the sleeves 80, although as above described and as shown in FIGS. 10 through 12, the starboard panel is initially folded upwardly.

Figure 12:
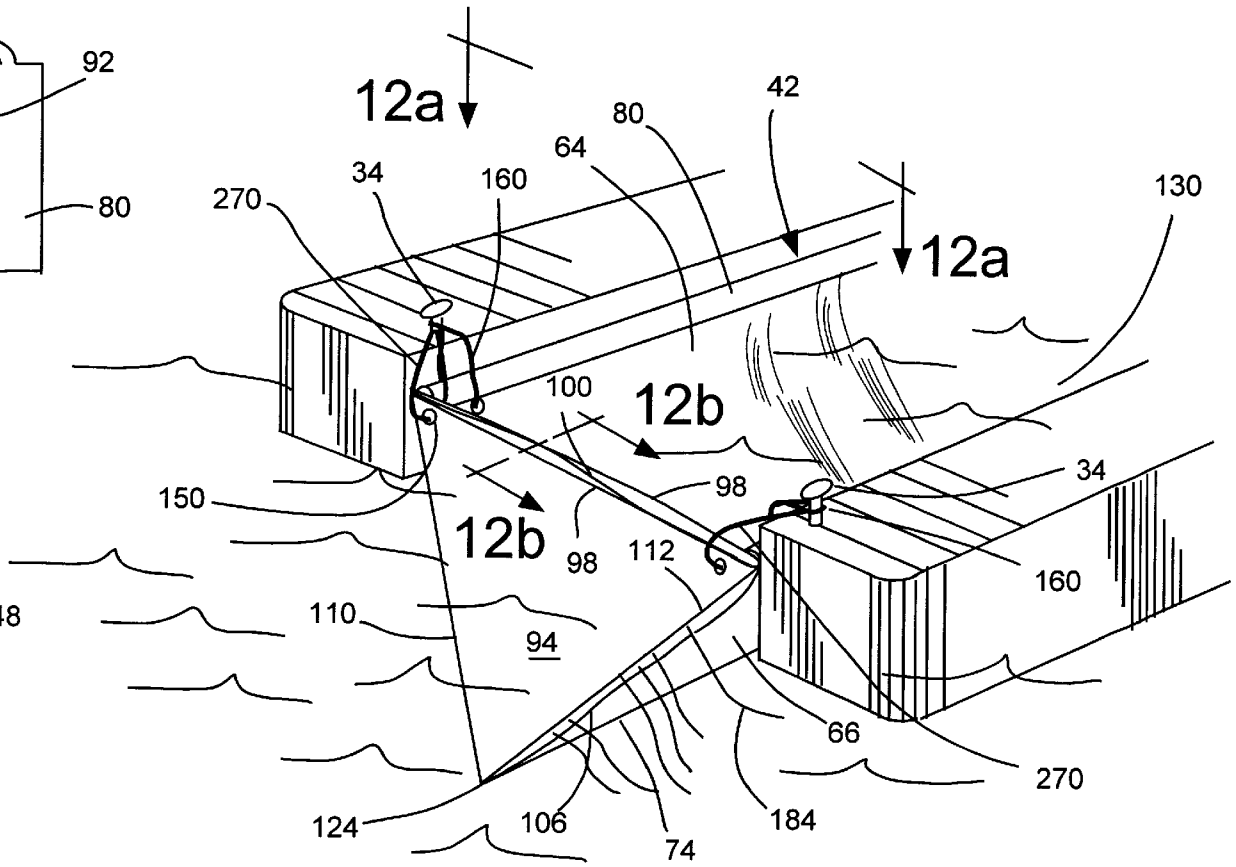
FIG. 12 is also a view similar to FIG. 10 but showing the gate in its fully closed position.
Figure 12A:
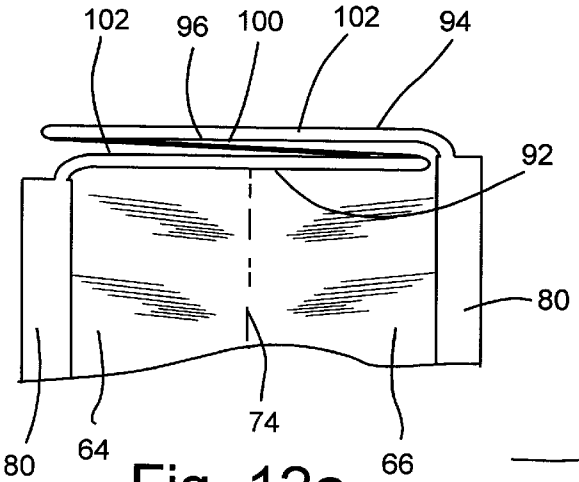
FIG. 12*a* is a fragmentary enlarged plan view of the aft end of the basin, as viewed from a position indicated by line 12*a*—12*a* in FIG. 12, showing the gate nearly closed, this view being for the purpose of showing the relationship of the panels of the gate in their closed positions.
Figure 12B:
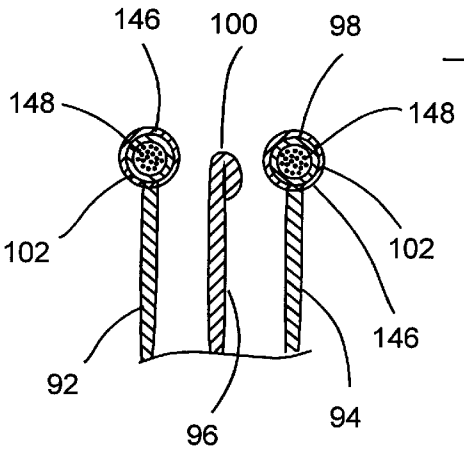
FIG. 12*b* is a fragmentary enlarged section taken on line 12*b*—12*b* in FIG. 12.
Figure 13:
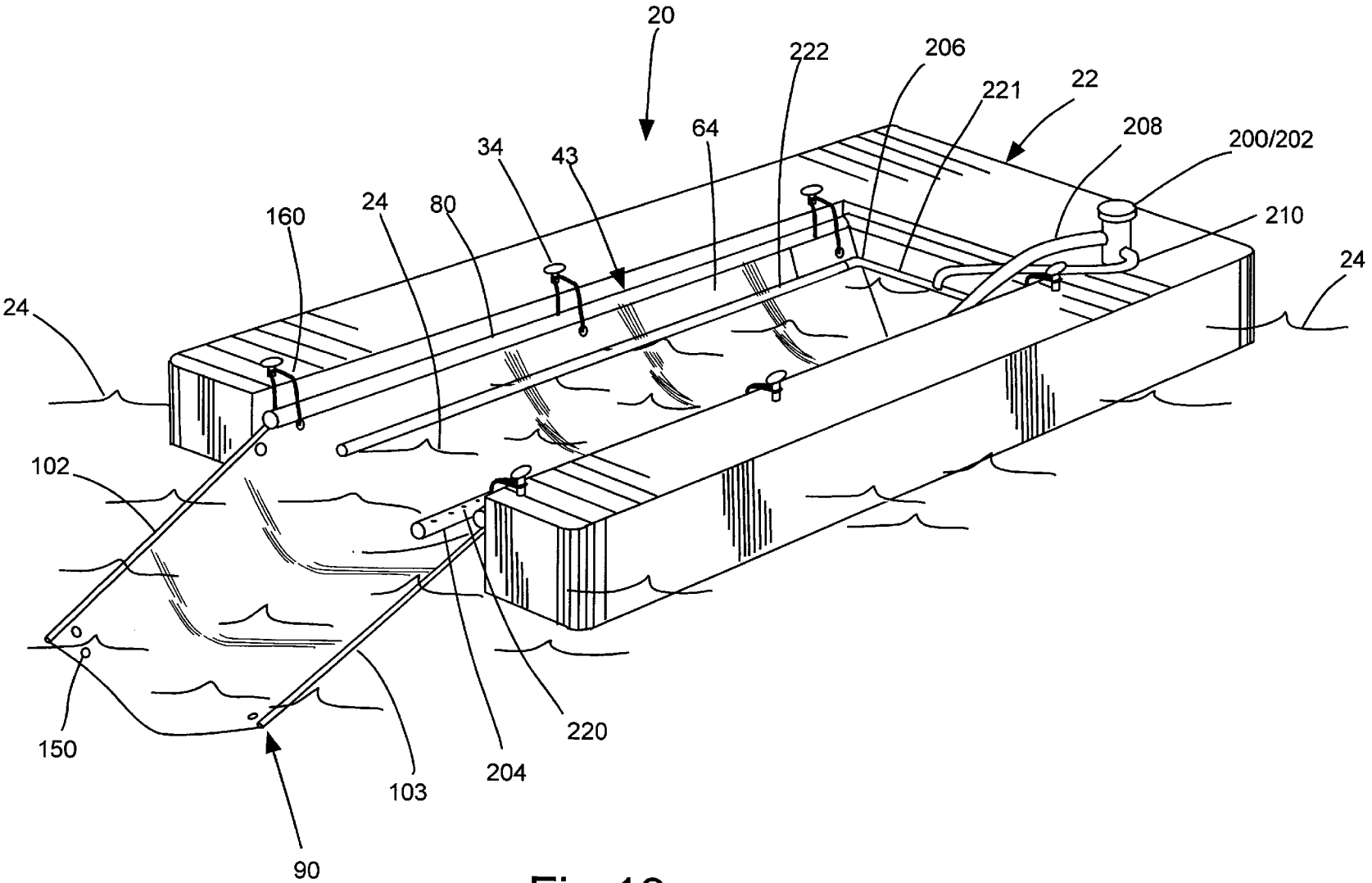
FIG. 13 is a perspective view of the subject boat maintenance apparatus in fully assembled condition floating within a floating dock, showing the aft end of the collector pipe resting in the nadir of the basin, showing one of the return pipes and part of the return manifold both floating on the water in the basin, and showing the gate open.

Assuming that the gate 90 is closed as illustrated in FIGS. 10–12, the corner 116 of the starboard panel 92 is fastened to the kitty-corner aft end 118 of the port sleeve 80, and the corner 118 of the port panel 94 is fastened to the aft end of the cattycorner starboard sleeve, both by tie lines 270. As previously mentioned, during the closing of the gate, water escapes as indicated at 182 and 184 thereby to equalize the pressure inside and outside of the basin so as to prevent the capture of water in the pool 170 from causing the basin to billow out of its desired shape. It is to be noted that the presence of the flotation tubes 160 in the sleeves 102 of the port and starboard panels not only assists in closing the gate but also helps to maintain the lateral V-shaped configuration of the basin.

It is here to be noted that the use of the terms "forward" and "aft" may suggest that a boat, such as 250, must always enter the apparatus 20 with its bow 252 first. It will be understood, however, that a boat may be backed in if so desired since the apparatus 20 will operate the same irrespective of which end of the boat enters the apparatus first.

With the boat 250 floating in the pool 170 of water in the chamber 130 (FIGS. 14–16), several dimensional relationships are to be noted. Thus, the maximum transverse dimension of the basin 42 between the upper edges 68 is greater than the maximum width of the hull 258 so that port and starboard spaces are provided on opposite sides of the hull, between the hull and the sidewalls 64 and 66 of the basin. Likewise, the length of the basin is longer than the boat so as to provide for minimal aft spaces between the forward end wall 50 and the bow 252 and between the gate 90 and the stern 254. These port and starboard spaces and the forward space provide room for the return piping 206 to float in the pool around the boat. Still further, the depth of the basin is sufficient to provide space between the keel 258 and the rudder 262 and the collector pipe 204 as well as the nadir 74 of the basin. Working space is thus provided around the boat for divers to operate in the chamber for cleaning the hull of the boat. If additional space is required at a particular location the boat can be moved transversely and longitudinally within the chamber by limited amounts. In this regard and as mentioned above, the principles of the present invention are adaptable to boats of various sizes, that is, the apparatus may be made larger or smaller as desired, although the invention is particularly suited for use with boats from about thirty feet in length to about seventy feet in length.

In this regard, it may be useful to provide the dimensions of a working example of the basin 42 of the present invention in order to gain an appreciation of the sizes here involved. In this example, the length of the sidewalls 64 and 66 laid out is approximately forty-eight feet, and each edge 54, 56, 98 and 100 is about eighteen feet, so that the total length of the forward and aft edges 70 and 72 in this example is about thirty feet. In the formed basin, however, the maximum transverse dimension of the basin in this example is about eighteen feet. If the basin is made of the Plastimayd vinyl sheet, the weight of such a basin approximates two-hundred pounds, as previously mentioned.

With the gate 90 closed behind a boat 250 in the chamber 130 (FIGS. 14–16), a closed fluid system is achieved by the filtration system 44 operating in the pool 170 of water in the chamber 130. That is, after the boat 250 is within the closed chamber 130, the filtration system 44 is turned on and a diver or divers enter the pool 170 and are free to move about in order to work on the hull 258, the keel 260, the rudder and other parts of the boat accessible to the diver or divers. The divers normally use scrub brushes to clean the hull and other underwater parts of the boat causing the removed materials to enter the water. These materials may include toxics such as lead from paint removed from the hull. The deck 264 of the boat may also be cleaned allowing the dirty water to wash over the sides of the boat into the pool.

Debris removed from the boat 250 (FIGS. 14–16) as well as cleaning materials used above the waterline enter the pool 170 of water and settle onto the side walls 64 and 66. Because these walls are planar and sloped toward the nadir 74, the solids and particulates in the water gravitate down these walls toward the collector pipe 204. There, the water and water borne solids are sucked into the collector pipe through the apertures 220 and are carried by the pump into the filter. The filter removes the contaminants and releases clean water to the manifold 221 and the return pipes 222. Clean water exits the return pipes in gentle sprays through the apertures 230 onto the upper surface of the pool adjacent to and above the side walls. This gentle downward spray or shower of clean water tends to establish currents causing the suspended materials to gravitate onto the side walls and toward the collector pipe.

The slope of the side walls 64 and 66 (FIGS. 14–16) and the spray of clean water from the return pipes 22 greatly facilitate movement of settling solids toward the collector pipe 204. Moreover, the reach of the collector pipe throughout the entire length of the basin 42, that is the length of the nadir 74, greatly improves the speed and thoroughness of circulation and removal of contaminated water from the pool. This is to be contrasted with my prior U.S. Pat. No. 5,138,963 wherein all of the contaminated water must enter the single outlet from the basin. Since this is a relatively closed system, the pool 170 is isolated from the surrounding sea water 24 so that the water borne contaminants do not enter the surrounding sea water nor even the surrounding air since the substances remain in the water, gravitate into the collector pipe, and are immediately sent into the filter 202.

After the boat 250 (FIGS. 14–16) has been cleaned or otherwise serviced, the divers exit from the pool 170, and the filtration system 44 continues to operate in order to clean the water in the pool sufficiently to allow the gate 90 to be opened. Experience shows that after the diver or divers have completed their cleaning operating, the water in the pool is very discolored and may even appear to be black. Before the gate can be opened, therefore, it is necessary to clean this water so that its clarity returns to a normal state of cleanliness. It is here noted that when the divers are in the pool and cleaning the hull, there is considerable turbulence in the water tending to prevent the unwanted solids from gravitating toward the collector pipe 204. With the divers out of the water and cleaning operation completed, the water in the pool can become more placid, and for thorough cleaning of the pool, it is important that the water in the pool remain in a relatively quiet state. Since it is necessary to continue to operate the filtration system 44 in order to clean the water in the pool, however, the water would remain turbulent if the cleaned return water were merely ejected back into the pool in a strong stream, as in my earlier patent cited above. The subject return piping 206 avoids this problem. That is, the use of the return pipes 222 that feed the returning clean water to the pool in a gentle shower along each side wall 64 and 66 minimizes the turbulence in the water. As a result, not only is the turbulence minimized but the gentle shower of water over the side walls tends to assist in causing solid materials to gravitate toward the collector pipe 204 along the side walls.

Although a preferred embodiment of the present invention has been shown and described, various modifications, substitutions and equivalents may exist without departing from the spirit and scope of the invention. Accordingly, it is to be understood that the present invention has been disclosed by way of example and not by way of limitation.

What is claimed is:

1. An apparatus for use in cleaning the hull of a boat while the boat is in the water, comprising;

a water-impervious basin of predetermined shape having length and width dimensions large enough to receive a boat therein, the basin having a bottom providing a nadir having a length that spans substantially the entirety of at least one of said dimensions of the basin and having a substantially uniform depth throughout its length, sides extending downwardly to the nadir, an opening allowing water to enter the basin, and a gate at the opening and movable from an open position allowing ingress and egress of boats and a closed position over the opening so as to capture a pool of water in the basin; and a water filtration system including a collector lying in and extending substantially the full length of the nadir for removing unfiltered water from the basin, and an outlet for returning filtered water to the basin.

2. The apparatus of claim 1, wherein the sides are sloped downwardly toward the collector at an angle that causes contaminants on them to gravitate toward the collector.

3. The apparatus of claim 1, wherein the collector is an elongated pipe having apertures therein; and wherein the sides are sloped downwardly toward the pipe at an angle that causes contaminants on them to gravitate toward the pipe.

4. The apparatus of claim 1, wherein the sides are planar walls that slope downwardly toward the nadir.

5. The apparatus of claim 4, where the walls are in V-shaped relation to each other with the nadir being at the juncture of the walls; and wherein the pipe lies in said juncture.

6. The apparatus of claim 1, wherein the collector is not attached to the basin.

7. The apparatus of claim 1, wherein the collector is not attached to the basin; and wherein the basin is reversible.

8. The apparatus of claim 1, wherein the nadir extends the full length of the basin; and wherein the collector lies along the full length of the nadir.

9. An apparatus for use in cleaning the hull of a boat while the boat is in the water, comprising;

a water-impervious basin having length and width dimensions large enough to receive a boat therein, the basin having a bottom, sides extending downwardly to the bottom, an opening allowing water to enter the basin, and a gate at the opening and movable from an open position allowing ingress and egress of boats and a closed position over the opening so as to capture a pool of water in the basin; and a water filtration system including collector on the bottom for removing unfiltered water from the basin, and a flotatable return adapted to float on the water in the basin for returning filtered water to the basin.

10. The apparatus of claim 9, wherein the return includes floatable return pipes extending along and above the sides of the basin.

11. The apparatus of claim 9, wherein at least one of the sides is sloped downwardly toward the bottom at an angle that causes contaminants on it to gravitate toward the bottom; and wherein the return is an elongated pipe having apertures therein and extending lengthwise of the basin above said one of the side walls.

12. The apparatus of claim 9, where the sides are in V-shaped relation to each other and converge in the bottom of the basin; and wherein the return includes a pair of floatable return pipes individually extending lengthwise of the basin over the sides thereof.

13. The apparatus of claim 12, wherein the bottom provides a nadir that spans substantially the entirety of at least one of said dimensions of the basin;

wherein the sides extend downwardly to the nadir;

wherein the collector is an elongated pipe having apertures therein and lying in the nadir; and wherein the return pipes have apertures directed downwardly toward the sides.

14. An apparatus for use in cleaning the hull of a boat while the boat is in the water while avoiding or minimizing pollution of the air or water, comprising:

an impervious flotation basin having first and second ends, longitudinally extending upper edges, a bottom defining an elongated, longitudinally extending nadir of the basin, substantially planar side walls sloping downwardly from the edges to the nadir, a boat opening, and a gate mounted on the walls and movable from an open position relative to the opening and a closed position over the opening, the walls and the gate in closed position forming a chamber adapted to contain a pool of water in which a boat may be floated; and a water filtration system having a collector lying along the nadir but unattached to the basin and return piping floatable on the water in the basin and unattached thereto.

15. The apparatus of claim 14, wherein flotation tubes are attached along the upper edges of the basin.

16. The apparatus of claim 14, wherein the collector is an elongated pipe extending along and resting in the nadir of the basin, not attached thereto, and having inlet apertures therealong.

17. The apparatus of claim 14, wherein the return includes flotation pipes extending lengthwise of the basin above the side walls, not attached thereto, and having outlet apertures therealong.

18. The apparatus of claim 14, wherein the collector is an elongated pipe extending along and resting in the nadir of the basin, not attached thereto, and having upwardly directed inlet apertures therealong; and wherein the return includes a pair of elongated flotation pipes extending lengthwise of the basin above the side walls, not attached thereto, and having downwardly directed outlet apertures therealong.

19. The apparatus of claim 14, wherein the upper edges of the basin have sleeves therealong;

wherein flotation pipes are in the sleeves;

wherein the basin is flexible, has opposite surfaces, and is reversible so that said surfaces can be oriented to face either up or down; and wherein fasteners are releasably connected to the upper edges of the basin and are adapted to tether the basin on a dock but to allow it to float relative to the dock and to be removed from the dock thereby to enable reversing of the basin.

20. The apparatus of claim 14, wherein the side walls extend lengthwise of the basin; and wherein the gate includes panels foldable between an open position with the panels longitudinally extending from the side walls and a closed position with the panels in overlaid relation at the ends of the side walls.

21. The apparatus of claim 20, wherein the panels form a water passageway therebetween as the panels are being moved from open to closed positions with the passageway establishing fluid communication between the inside and the outside of the basin as the panels are moving from their open position to their closed position.

22. The apparatus of claim 20, wherein there are outer, intermediate, and inner panels when the gate is closed;

wherein the panels have upper edges in the closed position of the gate and first and second fold lines; and wherein the panels fold first along the first fold line and then along the second fold line in moving into the closed position of the gate with the passageway being temporarily formed between the outer panel and the intermediate and inner panels when the panels are folded along the first fold line and before being folded along the second fold line.

23. The apparatus of claim 20, wherein there are outer, intermediate, and inner panels when the gate is closed;

wherein the panels have upper edges in the closed position of the gate and first and second fold lines;

wherein there is a rigid reinforcing member extending along and attached to the upper edge of at least two of the panels weighing the panels down in the open position of the gate and serving as handles to facilitate closing of the gate.

24. An apparatus for use in cleaning the hull of a boat while the boat is in the water while avoiding or minimizing pollution of the air or water, comprising:

an impervious flotation basin of flexible sheet material having a bottom, end and side walls extending downwardly to the bottom, a boat opening opposite from the end wall, and a gate mounted on the walls and movable from an open position relative to the opening and a closed position over the opening, the walls and the gate in closed position forming a chamber of predetermined shape adapted to contain a pool of water in which a boat may be floated, the gate having predetermined negative buoyancy in order to float in its open position at a predetermined depth below the surface of the water adjacent to the opening at the entrance to the chamber, the chamber being maintained in substantially said predetermined shape by the material of the basin and the interconnection of the end and side walls and the gate in closed position; and a water filtration system having a collector and a return for respectively removing contaminated water from the basin and returning cleaned water to the basin.

25. An apparatus for use in cleaning the hull of a boat while the boat is in the water while avoiding or minimizing pollution of the air or water, comprising:

an impervious flotation basin having a bottom, side walls extending downwardly to the bottom, a boat opening and a gate mounted on the walls and movable from an open position relative to the opening and a closed position over the opening, the walls and the gate in closed position forming a chamber adapted to contain a pool of water in which a boat may be floated, the gate having predetermined negative buoyancy in order to float in its open position at a predetermined depth below the surface of the water adjacent to the opening at the entrance to the chamber; and a water filtration system having a collector and a return for respectively removing contaminated water from the basin and returning cleaned water to the basin, wherein the gate includes panels foldable between an open position with the panels longitudinally extending from the side walls and a closed position with the panels in overlaid relation at the ends of the side walls; and wherein flotation pipes with negative buoyancy are attached to the panels.

26. An apparatus for maintaining a boat that has length and width dimensions and a keel, comprising:

an elongated, floatable collector basin of flexible, water-impervious sheet material having generally planar side walls in V-shaped relation to each other and sloped downwardly from upper edges to a nadir of the basin, a closed end wall extended downwardly from an upper edge to the nadir, an open end opposite to the closed end wall, a maximum transverse dimension between the sides greater than the width of the boat, a length dimension between the closed end wall and the open end greater than the length of the boat, a depth dimension greater than the depth of the keel, and a gate at the open end foldable between an open position allowing passage of a boat through the open end and a closed position closing the open end and forming with the side and closed end walls and nadir a trough-shaped working chamber for performing maintenance on a boat in the chamber, tethering lines connected to the side walls adjacent to the upper edges; and a filtration system including a combination pump and filter having an inlet and an outlet, an elongated perforated collector pipe lying in and along the full length of the nadir, being connected to the inlet, and having upwardly directed apertures spaced therealong, the filtration system also having a pair of elongated perforated return pipes extending lengthwise substantially the full length of the basin over the side walls, being connected to the outlet, and having downwardly directed apertures therein.

27. A boat maintenance apparatus comprising:

a U-shaped floating dock having an open end for allowing vessels to move into and out of the dock;

a floatable V-shaped basin made of a flexible, waterproof sheet tethered to the dock and defining a chamber below the dock into which the hull of a vessel in the dock is located, the basin having a gate movable between an open position to enable entry and egress of boats to and from the chamber and a closed position completely enclosing submerged portions of the hull of a vessel in the dock, the basin dimensions being greater than those of the enclosed vessel hull to form an enclosed chamber between the basin and opposing hull surfaces below the water level with the basin surface spaced from the opposing hull surfaces across its entire submerged area;

a pump and filter assembly having an inlet and an outlet and mounted on the dock for filtering debris from water pumped through the filter assembly, the assembly further including a perforated collector pipe lying along and at the bottom of the basin at the juncture of the Vee of the basin, an collector hose interconnecting the inlet and the collector pipe, a perforated return pipe extending lengthwise of the basin, and an return hose interconnecting the outlet and the return pipe.

28. The apparatus of claim 27, wherein the sheet has opposite first and second surfaces and is reversible for selectively mounting said surfaces facing upwardly; and wherein the collector and return pipes are not attached to the basin and are movable from the basin to the dock to facilitate reversing of the basin.

29. An apparatus for use in cleaning the hull of a boat while the boat is in the water, comprising:

a dock;

a basin made of a flexible vinyl sheet having first and second ends, longitudinally extending upper side edges, an elongated nadir extending from the first end to the second end, substantially planar side walls sloping downwardly in V-shaped relation from the side edges to the nadir and along the full length thereof, a first end wall closing the first end of the basin and extending downwardly from an upper edge to the nadir, and a gate mounted on the second end and movable from an open position wherein the second end is open and a closed position enclosing the second end, the side walls, the first end wall and the gate in closed position forming an inverted polyhedral tent-like chamber and being maintained in said shape by the interconnection of the side and end walls and the gate in its closed position, the upper edges having sleeves, and flotation tubes in the sleeves, the gate including a plurality of panels foldable from said open position with the panels individually forming generally longitudinal extensions of the side walls, to a partially closed position, to said closed position with the panels in overlaid relation at ends of the side walls, the panels forming in their partially closed position a water passageway therebetween with the passageway having an inside inlet opening into the chamber and an outside outlet opening out of the chamber whereby the passageway establishes fluid communication between the chamber and the exterior of the basin as the panels are moving from their open position to their closed position, the panels having upper edges that are extensions of the upper side edges of the basin and in which are provided sleeves, the gate also having a flotation tube with negative buoyancy in each sleeve, the panels also terminating in an end edge at the second end of the sheet, the panels being foldable into said closed position with the upper edges and the floating tubes in the gate coextensive and on opposite sides of said end edge;

ties releasably tethering the upper edges of the basin from the dock;

ties releasably attaching the gate to the dock in its closed position; and a water filtration system having a collector pipe extending along the full length of and resting in the nadir of the basin and not being attached thereto, the collector pipe having upwardly directed inlet apertures spaced therealong, a pair of return pipes extending the full length of the basin respectively over the side walls and connected to a manifold, and a pump and a water filter interconnecting the collector pipe and the manifold.

30. A method of cleaning a boat in a basin made of flexible sheet material wherein the basin is floating in the body of water and can be opened and closed to allow a boat to enter and leave the basin and wherein water from the body of water enters the basin when it is open and the basin thereby contains a pool of water substantially isolated from the body of water when the basin is closed, the basin having a predetermined shape larger than the boat so that when the boat is in the basin, the hull of the boat is spaced from the basin fore and aft and port and starboard of the boat providing working space between the boat and the basin, comprising:

moving the boat from the body of water into a pool of water while the basin is open and thereafter closing the basin to float the boat in the pool of water;

controlling the volume of water in the pool as the boat enters the pool so that the basin does not billow out of said shape;

cleaning the boat while in the pool of water; and opening the basin and removing the boat from the pool.

31. The method of claim 30, including the steps of:

withdrawing water and water-borne contaminants from the pool during the cleaning operation and before the basin is opened to allow the boat to be removed.

32. The method of claim 31, causing contaminants in the water from the cleaning operation to gravitate to the bottom of the basin while minimizing turbulence in the water thereby to facilitate said withdrawing step.

33. The method of claim 32, wherein the causing step involves creating currents of water in the pool directed toward the bottom of said basin thereby to sweep contaminants toward said area.

34. The method of claim 33, wherein the causing step involves returning cleaned water to the pool in a spray above the pool.

35. The method of claim 31 wherein the moving step involves the use of a reversible basin having a nadir and wherein the withdrawing step involves the use of a collector pipe lying in the nadir of the basin but not attached thereto, including the steps of:

lifting the pipe out of the basin;

turning the basin inside out thereby reversing the basin; and laying the pipe back into the nadir.

36. A method of cleaning a boat in a body of water, comprising the steps of:

moving the boat from the body of water into a pool of water that is isolated from the body of water;

releasing water from the pool into the body of water as the boat is being placed in the pool thereby to control the volume of water in the pool;

cleaning the boat while in the pool of water;

withdrawing water and water-borne contaminants from the pool during the cleaning operation over an area that extends across substantially the full reach of the pool;

causing contaminants in the pool to gravitate toward said area including returning cleaned water to the pool in a spray above the pool that create currents of water in the pool directed toward said area thereby to sweep contaminants toward said area;

wherein the causing step involves returning cleaned water to the pool in sprays that extend lengthwise of the pool and in a downward direction to create said currents;

filtering the water in the pool while the boat is being cleaned thereby to remove contaminants from the pool caused by the cleaning operation; and removing the boat from the pool.

37. An apparatus for use in cleaning the hull of a boat while the boat is in the water, comprising;

a water-impervious basin of durable, flexible sheet material having length and width dimensions large enough to receive a boat therein, the basin having a triangular planar closed end wall joining a pair of rectangular planar side walls in a substantially V-shaped relation, an opening opposite to the end wall, and a gate connected to the side walls and foldable between a closed position interconnecting the side walls over the opening wherein it is triangular and an open position extended outwardly from the side walls exposing the opening, the side walls, the end walls, and the gate in its closed position forming a chamber within the basin and helping to maintain the chamber in a substantially V-shape.

38. The apparatus of claim 37, wherein there are elongated end and side support members attached to the end and side walls respectively and forming a U-shaped frame from which the end and side walls project downwardly.

39. The apparatus of claim 38, wherein the support members are flotation tubes.

40. The apparatus of claim 38, wherein there are elongated gate support members attached to the gate and from which the gate projects downwardly in its closed position, the end, side and gate support members in the closed position of the gate forming a rectangularly-shaped frame from which the basin is supported.

41. The apparatus of claim 40, wherein the support members are flotation tubes; and wherein the side and end flotation tubes have positive buoyancy and the gate flotation tubes have negative buoyancy.

42. The apparatus of claim 37, wherein the closed end wall and the side walls are initially two separate pieces of said sheet material; and wherein the closed end wall is heated-sealed to the side walls with the side walls in said substantially V-shaped relation to each other.

43. The apparatus of claim 37, wherein the closed end wall and the side walls are initially two separate pieces of said sheet material and joined together along juncture seams; and wherein the gate is part of the piece of sheet material that includes the side walls.

44. The apparatus of claim 37, wherein the side walls meet in a V-shaped juncture; and wherein there is weight extending lengthwise of the juncture and also helping to maintain the chamber in a substantially V-shape.

45. The apparatus of claim 44, wherein the weight is an outlet for water-borne contaminants in the basin.

46. The apparatus of claim 45, wherein the outlet is a pipe rested in the juncture and being unconnected to the basin.

47. The apparatus of claim 37 further providing:

a water filtration system including a collector for removing unfiltered water from the basin and an outlet for returning filtered water to the basin.

48. The apparatus of claim 47, wherein the side walls meet in a juncture defined by their V-shaped relationship; and wherein the filtration system includes a combination pump and filter having an inlet and an outlet, an elongated perforated collector pipe lying in said juncture, being connected to the inlet, and having upwardly directed apertures spaced therealong, the filtration system also having an elongated perforated return pipe extending lengthwise of the basin above the side walls, being connected to the outlet, and having downwardly directed apertures therein.

49. An apparatus for cleaning the hull of a boat while floating in water, the boat having length, width, and depth dimensions, comprising:

a floatable basin of flexible, water-impervious sheet material having side walls sloped downwardly from upper edges to a bottom of the basin, a closed end wall extended downwardly from an upper edge to the bottom, an open end opposite to the closed end wall, a maximum transverse dimension between the side walls greater than the width of the boat, a length dimension between the closed end wall and the open end greater than the length of the boat, a depth dimension greater than the depth of the boat, and a gate at the open end movable between an open position allowing passage of a boat through the open end and a closed position closing the open end and forming with the side and closed end walls and bottom a trough-shaped working chamber for performing maintenance on a boat in the chamber, the material of the sheet having sufficient thickness and thereby stiffness that together with the closed end wall and the gate substantially maintain both the trough-shape of the chamber and said transverse, longitudinal and depth dimensions when sufficient water is in the basin to float the boat therein.

50. The apparatus of claim 49, wherein the closed end wall joins the side walls along seams and holds the side walls in generally acute angular relation to each other; and wherein the gate is integral with the side walls and is folded into its closed position in which it, together with the closed end wall, maintains said acute angular relation between the side walls.

51. An apparatus for cleaning the hull of a boat while floating in water, comprising:

a floatable basin of predetermined shape bigger than the boat to-be-cleaned and made of flexible, water-impervious sheet material formed into side walls that slope downwardly from upper edges to a bottom of the basin, the side walls having opposite first and second ends and an extension constituting a gate that extends from the second ends of the side walls, a first end wall of said sheet material joining the first ends of the side walls and being extended downwardly from an upper edge to the bottom, the first end wall having a shape that defines the cross-sectional shape of the basin, there being an opening between the second ends of the side walls and opposite to the first end wall, the gate being foldable along multiple fold lines from an unfolded open position in which it extends endwardly from the second ends of the side walls for allowing passage of a boat into or out of the basin and a folded closed position wherein it has substantially the shape of the first end wall and closes the opening, the first end wall and the gate in closed position maintaining the basin in substantially its predetermined shape.

52. The apparatus of claim 51, wherein the gate has multiple overlapping panels in its closed position.

53. The apparatus of claim 51, wherein there are flotation tubes attached to the gate having negative buoyancy that maintains the gate in an endwardly downwardly sloping condition in the open position of the gate.

54. The apparatus of claim 51, wherein there are flotation tubes attached to the side and first end walls forming a U-shaped frame supporting the basin.

55. The apparatus of claim 51, wherein there are flotation tubes attached to the gate having negative buoyancy that maintains the gate in an endwardly downwardly sloping condition in the open position of the gate and are in overlapping side-by-side relation in the closed position of the gate; and wherein there are flotation tubes attached to the side and first end walls that form a rectangular-shaped frame with flotation tubes for the gate.

* * * * *